US009458854B2

(12) United States Patent
Cananzi et al.

(10) Patent No.: US 9,458,854 B2
(45) Date of Patent: Oct. 4, 2016

(54) ELECTRICAL CONNECTION MECHANISM FOR REVERSIBLE FAN MODULE

(71) Applicant: Arista Networks, Inc., Santa Clara, CA (US)

(72) Inventors: David Cananzi, Santa Clara, CA (US); Jiayi Wu, Santa Clara, CA (US); Richard Hibbs, Santa Clara, CA (US); Robert Wilcox, Santa Clara, CA (US)

(73) Assignee: Arista Networks, Inc., Santa Clara, CA (US)

( * ) Notice: Subject to any disclaimer, the term of this patent is extended or adjusted under 35 U.S.C. 154(b) by 0 days.

(21) Appl. No.: 14/682,852

(22) Filed: Apr. 9, 2015

(65) Prior Publication Data

US 2016/0146212 A1 May 26, 2016

Related U.S. Application Data

(63) Continuation-in-part of application No. 14/549,945, filed on Nov. 21, 2014.

(51) Int. Cl.

| | |
|---|---|
| ***F04D 27/00*** | (2006.01) |
| ***F04D 25/06*** | (2006.01) |
| ***F04D 25/08*** | (2006.01) |
| ***F04D 19/00*** | (2006.01) |

(52) U.S. Cl.

CPC ..... *F04D 27/00* (2013.01); *F04D 19/002* (2013.01); *F04D 25/06* (2013.01); *F04D 25/08* (2013.01)

(58) Field of Classification Search

CPC ..... G06F 1/181–1/182; H05K 7/20218–7/20381; H05K 7/20409–7/20418; H05K 7/20009–7/202; H01L 23/367–23/3677; H01L 23/473; H01L 23/46–23/467; F04D 27/00; F04D 25/06–25/08; F04D 19/002

USPC ..... 361/676–678, 679.46–679.54, 361/688–723; 165/80.1–80.5, 104.33, 185; 174/15.1–15.3, 16.1–16.3, 547, 548; 257/712–722, E23.088; 24/453, 24/458–459; 454/184; 312/236

See application file for complete search history.

(56) References Cited

U.S. PATENT DOCUMENTS

| | | | | |
|---|---|---|---|---|
| 6,071,082 | A * | 6/2000 | Lecinski | F04D 25/166 361/695 |
| 6,185,097 | B1 | 2/2001 | Behl | |
| 6,213,866 | B1 | 4/2001 | Impellizzeri | |
| 6,537,019 | B1 * | 3/2003 | Dent | F04D 25/166 361/679.48 |
| 6,587,342 | B1 * | 7/2003 | Hsu | G06F 1/20 165/80.3 |
| 6,604,916 | B2 * | 8/2003 | Lu | H05K 7/20581 361/695 |
| 6,717,809 | B2 * | 4/2004 | Chen | H05K 7/207 361/695 |
| 6,749,398 | B2 * | 6/2004 | Lu | F04D 29/703 29/889.1 |
| 6,961,248 | B2 * | 11/2005 | Vincent | H05K 7/20736 361/679.46 |
| 6,985,358 | B2 * | 1/2006 | Thompson | H05K 7/20581 165/104.33 |

(Continued)

*Primary Examiner* — Anthony Haughton
*Assistant Examiner* — Razmeen Gafur
(74) *Attorney, Agent, or Firm* — Osha Liang LLP

(57) ABSTRACT

A reversible fan module may include a first attachment member that may receive power from a controller when an orientation of the reversible fan module is a first orientation; a second attachment member that may receive power from the controller when the orientation of the reversible fan module is a second orientation; a first electrical connection, disposed between the first attachment member and the second attachment member, that may transmit power from the second attachment member to the first attachment member when the orientation of the reversible fan module is the second orientation; and a second electrical connection, disposed between the first attachment member and a fan unit, that may transmit power to the fan unit.

14 Claims, 19 Drawing Sheets

(56) References Cited

U.S. PATENT DOCUMENTS 7,285,756 B2 * 10/2007 Leppich ..... F24C 15/325 126/21 A
7,492,591 B1 * 2/2009 Aybay ..... H05K 7/20581 312/236
7,542,272 B2 * 6/2009 Pike ..... G06F 1/20 165/80.3
7,675,747 B1 * 3/2010 Ong ..... F04D 19/024 361/679.46
7,729,116 B1 * 6/2010 Aybay ..... H05K 7/20736 312/236
7,983,039 B1 * 7/2011 Nguyen ..... H05K 7/20727 361/694
8,068,340 B1 * 11/2011 Nguyen ..... F04D 25/0613 165/80.3
8,182,319 B2 * 5/2012 Ong ..... G06F 1/20 361/679.48
8,320,120 B1 * 11/2012 Chan ..... H05K 7/20727 165/121
8,493,732 B2 7/2013 Lineal et al.
8,582,294 B2 11/2013 Guerin et al.
9,253,928 B2 * 2/2016 Dickinson ..... H05K 7/20581
2002/0094282 A1 * 7/2002 Bendikas ..... F04D 25/166 417/360
2003/0184968 A1 * 10/2003 Steinman ..... H05K 7/20727 361/679.48
2004/0223301 A1 11/2004 Muller et al.
2005/0163615 A1 * 7/2005 Chheda ..... H01L 23/34 416/31
2005/0254210 A1 * 11/2005 Grady ..... H05K 7/20581 361/695
2006/0203446 A1 * 9/2006 Radhakrishnan ..... F04D 25/166 361/695
2007/0076368 A1 * 4/2007 Pike ..... G06F 1/20 361/679.48
2008/0038111 A1 * 2/2008 Iwasaki ..... F04D 25/02 415/198.1
2011/0014861 A1 1/2011 Tsai et al.
2011/0076932 A1 3/2011 Li
2011/0103011 A1 5/2011 Koplow
2011/0250831 A1 10/2011 Huang et al.
2012/0034860 A1 2/2012 Okada et al.
2012/0071076 A1 3/2012 Wei et al.
2012/0224325 A1 9/2012 Sun et al.
2012/0302150 A1 11/2012 Schmitt et al.
2013/0140968 A1 6/2013 Nagahori
2013/0168065 A1 7/2013 Sun
2013/0188309 A1 7/2013 Ross
2013/0188313 A1 7/2013 Dede
2013/0210334 A1 8/2013 Tan
2013/0231038 A1 9/2013 Chang
2013/0278120 A1 10/2013 Elkins
2013/0295834 A1 11/2013 Faist et al.
2013/0324025 A1 12/2013 Peng et al.

* cited by examiner

ELECTRICAL CONNECTION MECHANISM FOR REVERSIBLE FAN MODULE

CROSS-REFERENCE TO RELATED APPLICATIONS

The present application is a continuation-in-part of U.S. patent application Ser. No. 14/549,945 filed Nov. 21, 2014 and which is hereby incorporated in its entirety.

BACKGROUND

Electronic components generate heat and sometimes require active cooling such as an airflow generated by a fan. When electronic components are grouped closely together, the quantity of heat generated by the electronic components is sometimes sufficient to increase the temperature of the environment surrounding the electronic components. Further, in many cases, groups of electronic components are housed in structures that trap hot air around the electronic components which further increases the temperature of the environment around the electronic components.

SUMMARY

In one aspect, a reversible fan module according to one or more embodiments may include a first attachment member that may receive power from a controller when an orientation of the reversible fan module is a first orientation; a second attachment member that may receive power from the controller when the orientation of the reversible fan module is a second orientation; a first electrical connection, disposed between the first attachment member and the second attachment member, that may transmit power from the second attachment member to the first attachment member when the orientation of the reversible fan module is the second orientation; and a second electrical connection, disposed between the first attachment member and a fan unit, that may transmit power to the fan unit.

In one aspect, a system according to one or more embodiments may include a network device. The network device may include a controller that may read an orientation code of an attachment member of a reversible fan module attached to the controller; send the orientation code to the system controller; and provide power to the reversible fan module if the system controller indicates an orientation of the reversible fan module is acceptable. The network device may include a reversible fan module that may include a first attachment member that may receive power from a controller when an orientation of the reversible fan module is a first orientation; a second attachment member that may receive power from the controller when the orientation of the reversible fan module is a second orientation; a first electrical connection, disposed between the first attachment member and the second attachment member, that may transmit power from the second attachment member to the first attachment member when the orientation of the reversible fan module is the second orientation; and a second electrical connection, disposed between the first attachment member and a fan unit, that may transmit power to the fan unit.

In one aspect, a method according to one or more embodiments may include determining, by a controller, a quantity of present reversible fan modules; obtaining, by the controller, a minimum quantity of present reversible fan modules; initiating, by the controller, a timer; and shutting down, by the controller, a network device if the quantity of present reversible fan modules is less than the minimum quantity of present reversible fan modules when the timer reaches a value stored by the controller.

In one aspect, a method according to one or more embodiments may include initiating, by a controller, power transmission to a reversible fan module attached to the controller; reading, by the controller, an orientation code of an attachment member of a reversible fan module; sending, by the controller, a message to a system controller indicating the orientation code; receiving, by the controller, a message from the system controller indicating the acceptability of an orientation of the reversible fan module; and terminating, by the controller, power transmission to the reversible fan module if the received acceptability of the orientation of the reversible fan module is unacceptable.

BRIEF DESCRIPTION OF DRAWINGS

Certain embodiments of the invention will be described with reference to the accompanying drawings. However, the accompanying drawings illustrate only certain aspects or implementations of the invention by way of example and are not meant to limit the scope of the claims.

DETAILED DESCRIPTION

Figure 1:
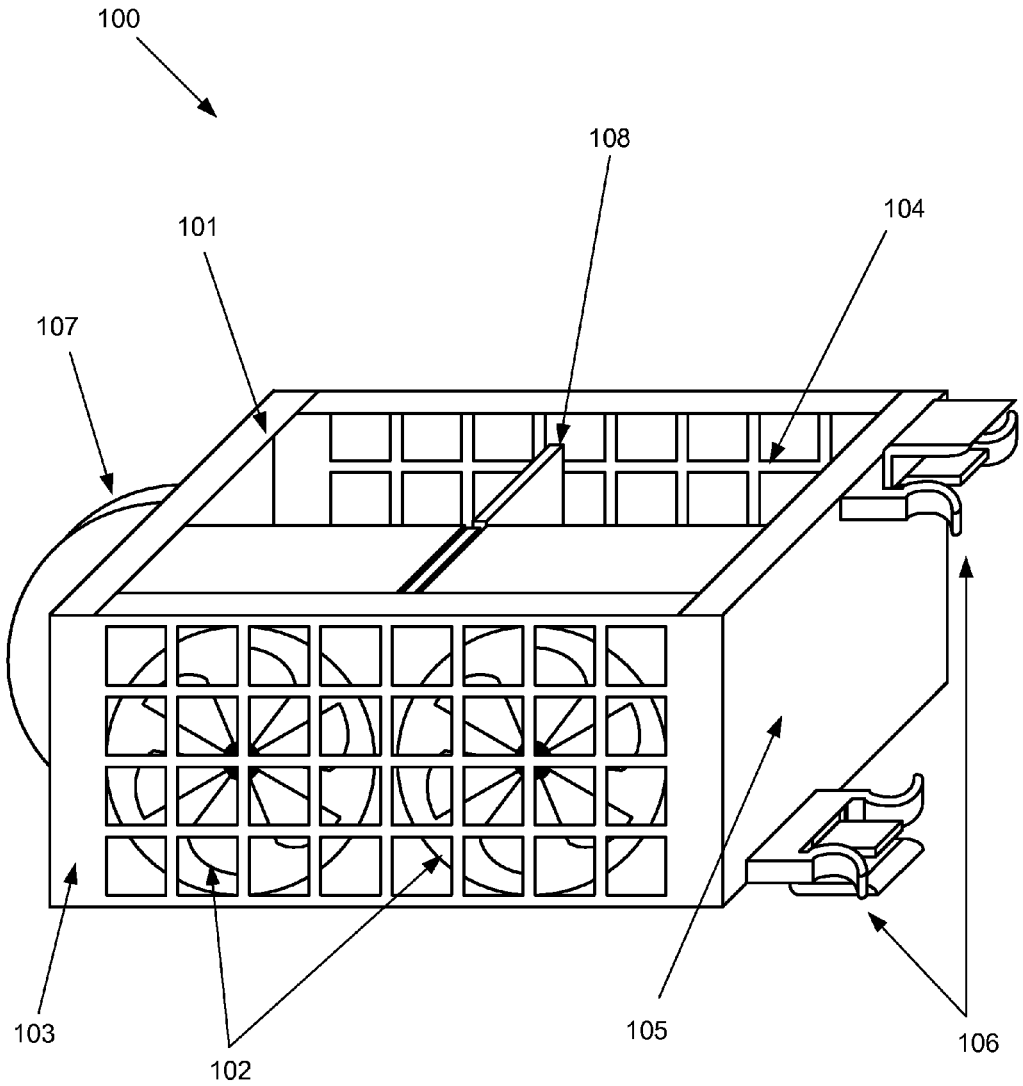
FIG. 1 shows a reversible fan module in accordance with one or more embodiments of the invention.

Specific embodiments will now be described with reference to the accompanying figures. In the following description, numerous details are set forth as examples of the invention. It will be understood by those skilled in the art that one or more embodiments of the present invention may be practiced without these specific details and that numerous variations or modifications may be possible without departing from the scope of the invention. Certain details known to those of ordinary skill in the art are omitted to avoid obscuring the description.

Embodiments of the invention include a system relating to controlling airflow and cooling within a chassis. In one or more embodiments of the invention, the chassis is part of a network switch or other electronic device located in a server farm or high density computing environment. In one or more embodiments of the invention, the system includes a reversible fan module and a chassis that controls airflow and cooling within a network switch or other electronic device. In one or more embodiments of the invention, the chassis includes a first opening and a second opening that are designed to take in cool air and exhaust hot air respectively, or the reverse. In one or more embodiments of the invention, the reversible fan module may reverse, or otherwise change, the flow of air within the chassis by changing the orientation of the reversible fan module.

In one or more embodiments of the invention, the reversible fan module may be configured to have at least two potential orientations within a chassis. Each orientation may be configured to create a different airflow pattern within the chassis.

Further, embodiments of the invention may take the form of methods of changing the direction of airflow within a chassis. The method may include inserting a reversible fan module in a first orientation, activating the reversible fan module, creating a forward airflow, and cooling at least one power supply. The method may also include removing the reversible fan module, inserting the reversible fan module in a second orientation, activating the reversible fan module in the second orientation, creating a reverse air flow, and cooling at least one power supply.

Additional embodiments of the invention include methods and systems for powering or controlling fan modules. In one or more embodiments of the invention, a reversible fan module and a controller may be disposed within a chassis of a network switch. The reversible fan module may include two or more attachment members configured to attach to the controller depending on the orientation of the reversible fan module within the bay. The location and orientation of each attachment member may be configured to only allow a single attachment member to connect to the controller when the reversible fan module is in any orientation.

Each attachment member may be associated with an orientation code. When an attachment member is attached to the controller, the controller may read the orientation code. Each orientation code corresponds to (or that otherwise represents) a current orientation and/or current a direction of airflow produced by the reversible fan module when the attachment member is connected to the receptacle. The orientation code may be a number (e.g., an integer, a real number, etc.), a character string (with one or more characters), or any combination thereof.

At any given time only one orientation code be read from the reversible fan module. Said another way, each reversible fan module may include one orientation code for each possible orientation of the reversible fan module. However, only a single orientation code, which reflects the current orientation of the reversible fan module, may be obtained by the controller.

In one or more embodiments of the invention, the controller may selectively power a reversible fan module attached to the controller. The controller may be configured to read the orientation code of an attachment member upon attachment to the controller and forward the orientation code of the controller to a system controller. The controller may wait for a response from the system controller and selectively power the reversible fan module based on the response.

In one or more embodiments of the invention, the system controller may be configured to communicate with a number of controllers. The system controller may receive messages from each of the controllers indicating the identity of each controller as well as the identity of each reversible fan module attached to each controller. The controller may determine if the orientation of each controller is acceptable. In one or more embodiments, the controller determines the acceptability of each orientation based on a layout of each controller within a data center or high density computing environment. In one or more embodiments of the invention, the controller determines the acceptability of each orientation based on a pattern. If the system controller determines a reversible fan module orientation is unacceptable, the system controller notifies the controller associated with the reversible fan module.

FIG. 1 shows an isometric view of a reversible fan module (100) according to one or more embodiments of the invention. The reversible fan module (100) includes a housing (101) and at least one fan unit (102) within the housing (101). When active, the fan units (102) cause an airflow into a front side (103) of the housing (101), through the housing (101), and out of a rear side (104) of the housing. The front side (103) and rear side (104) include a grating or screening element to allow airflow while preventing debris or other objects from entering the housing (101).

The reversible fan module (100) also includes at least one attachment member (106) disposed on a side face (105) of the reversible fan module (100). The attachment members (106) are adapted to be received by attachment receptacles to position and orient the reversible fan module (100) in a predetermined location. In one or more embodiments, two attachment members (106) are disposed on the side face (105) to enable positioning and orienting of the reversible fan module (100) during a reversal process.

In one or more embodiments of the invention, one of the attachment members connect to a controller when the reversible fan module (100) in the chassis. Each attachment member includes electrical contacts for receiving power from the controller and a digital identifier that may be read by the controller. The electrical functionality of the attachment members is described in detail below in FIGS. 10-17.

Figure 2B:
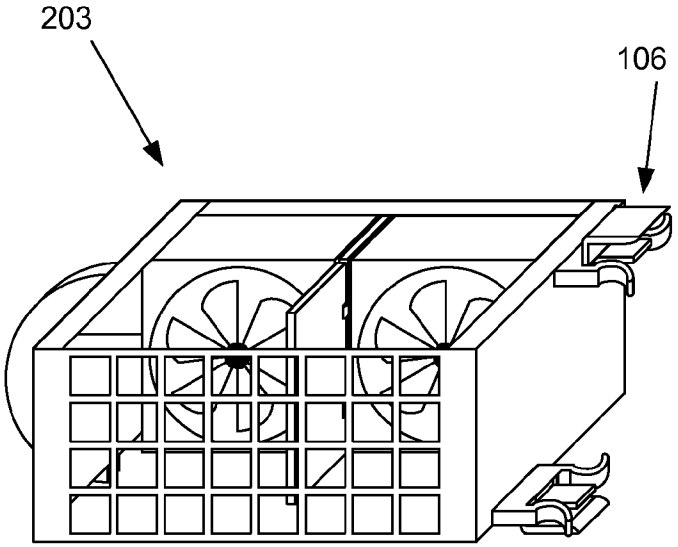
FIGS. 2A-B show a reversible fan module in accordance with one or more embodiments of the invention.
Figure 2A:
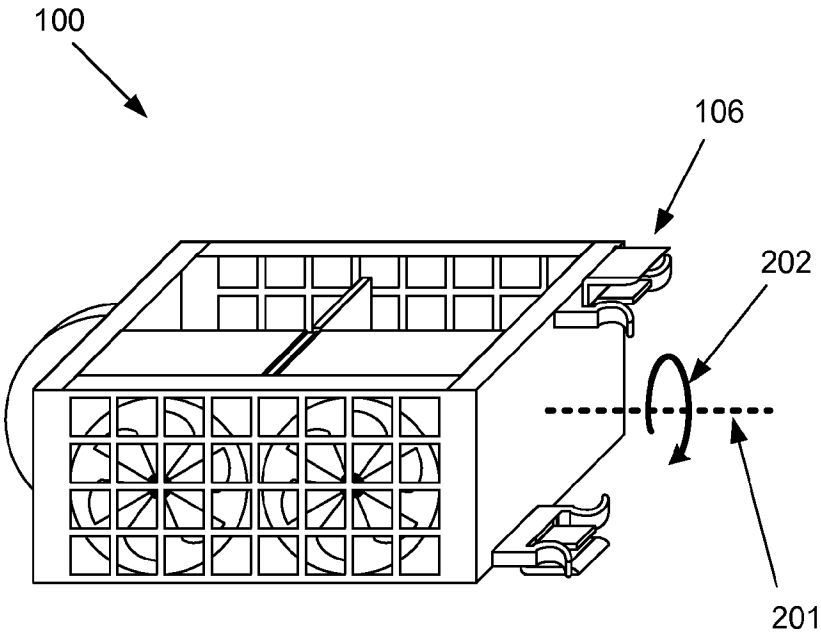

FIG. 2 shows a reversal process in accordance with one or more embodiments. Specifically, FIG. 2A shows a reversible fan module (100) before being reversed and FIG. 2B shows a reversible fan module (100) after being reversed. The reversible fan module (100) is reversed by rotating (202) the reversible fan module (100) about a line (202) that is orthogonal to the side face (105) and extends through a point at the center of the reversible fan module (100). By rotating (202) the fan module 180° about the line (202), the front side (103) and rear side (104) switch locations. Thus, a reversed reversible fan module (203) causes an air flow in the opposite direction of a reversible fan module (100) before being reversed. Additionally, the two attachment members (106) are located and oriented such that, when reversed, the attachment members (106) occupy the same relative positions and orientations before reversal. Therein, a single set of attachment members may be used to position and orient a reversible fan module (100) within the chassis (not shown) before and after reversal.

Returning to FIG. 1, the reversible fan module (100) also includes a handle (107) disposed on a face opposite the side face (105). The handle enables the reversal process shown in FIG. 2. The handle is aligned with the orthogonal line (202). Rotating the handle (107) by 180° reverses the reversible fan module (100).

The reversible fan module (100) further includes a closing element (108). The closing element (108) prevents a counter air flow, such as an airflow reversal or circulation, when a fan unit (102) becomes inactive. For example, if a fan unit (102) fails due to an internal short or some other cause it may become inactive.

Figure 3:
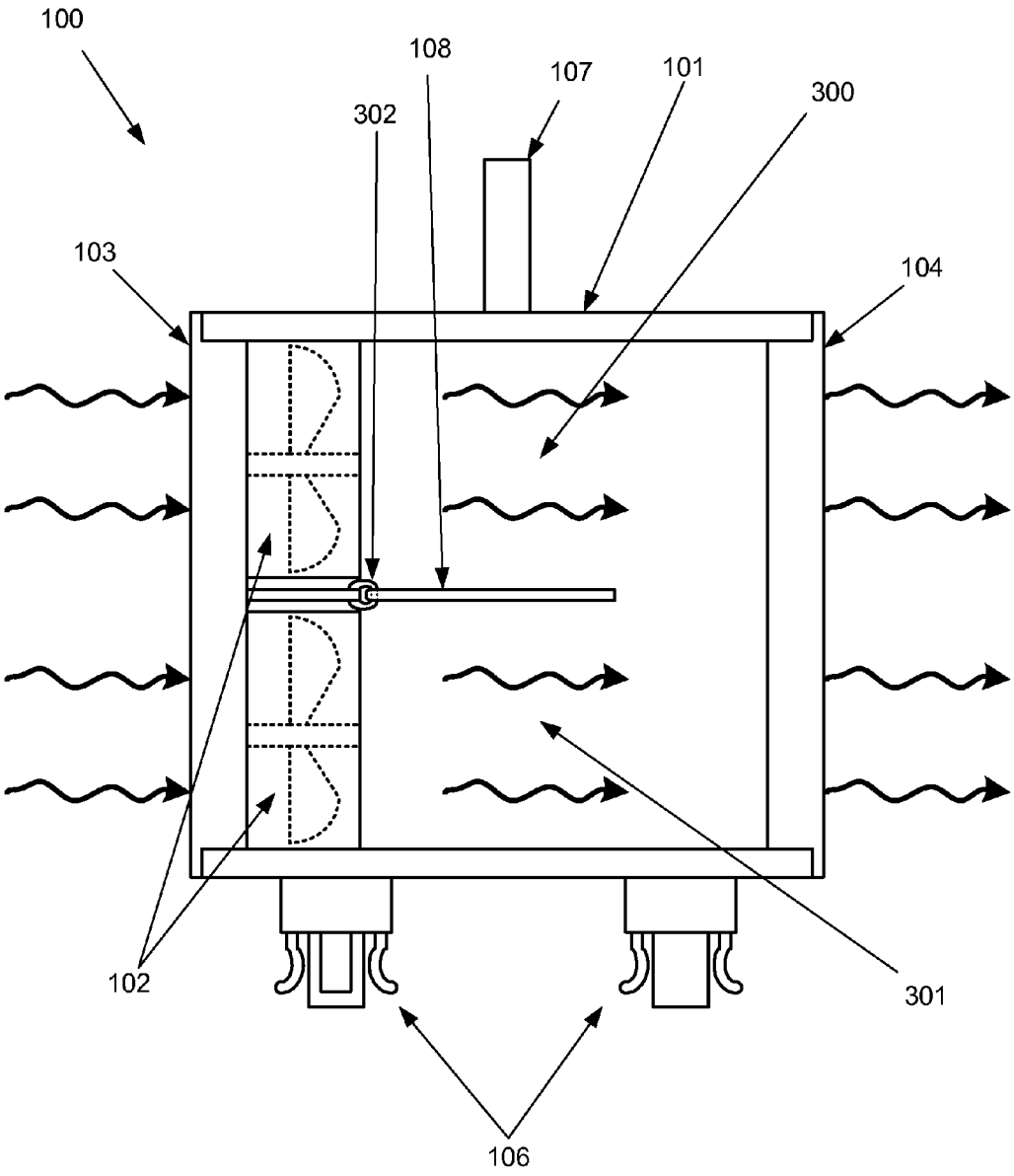
FIG. 3 shows a reversible fan module in accordance with one or more embodiments of the invention.

FIG. 3 shows a top view of the reversible fan module (100) in accordance with one or more embodiments of the invention. In addition to showing various features and components of the reversible fan module (100). FIG. 3 also illustrates airflow when all fan units (102) are active. Airflow is indicated by arrows with wavy tails. As seen from the arrows, air flows into the front side (103), through the housing (101), and out of the rear side (104). When inside the housing (101), the airflow is divided into a first sub-airflow and a second sub-airflow, by the closing element (103), that flows through a first housing airflow channel (300) and second housing airflow channel (301), respectively. The closing element (108) is connected to a linkage (302) that is attached to the housing (101). The linkage (101) enables the closing element (108) to rotate about the linkage (108), e.g. as a pivot point. The linkage (101) does not restrict the rotation of the closing element (108) which enables the closing element (108) to rotate according to the flow of air around the closing element. By rotating freely, the closing element (108) is able to prevent the reverse of an air flow or the circulation of an air flow due to an inactive fan unit (102).

In some cases, a reversible fan module (100) may be placed at a location that would naturally lead to a flow of air in the opposite direction as would be caused by the fan units (102). For example, if the rear side (104) was placed in a high air pressure area and the front side (103) was placed in a low pressure area an air flow would naturally occur from the rear side (104) to the front side (103) in the absence of active fan units (102). Accordingly, if a fan unit (102) failed in such an orientation, a reverse airflow or an airflow circulation within the housing (101) may render the reversible fan unit (100) useless. To prevent the reversible fan module (100) from being rendered useless due to an inactive fan unit (102), the closing element (108) is designed to close off a first housing airflow channel (300) or a second housing airflow channel (301). The operation of the closing element (108) is further clarified by way of example in FIGS. 4 and 5 when the reversible fan module (100) is placed at a location that would lead to a reversed airflow without fan unit (102) activity.

Figure 4A:
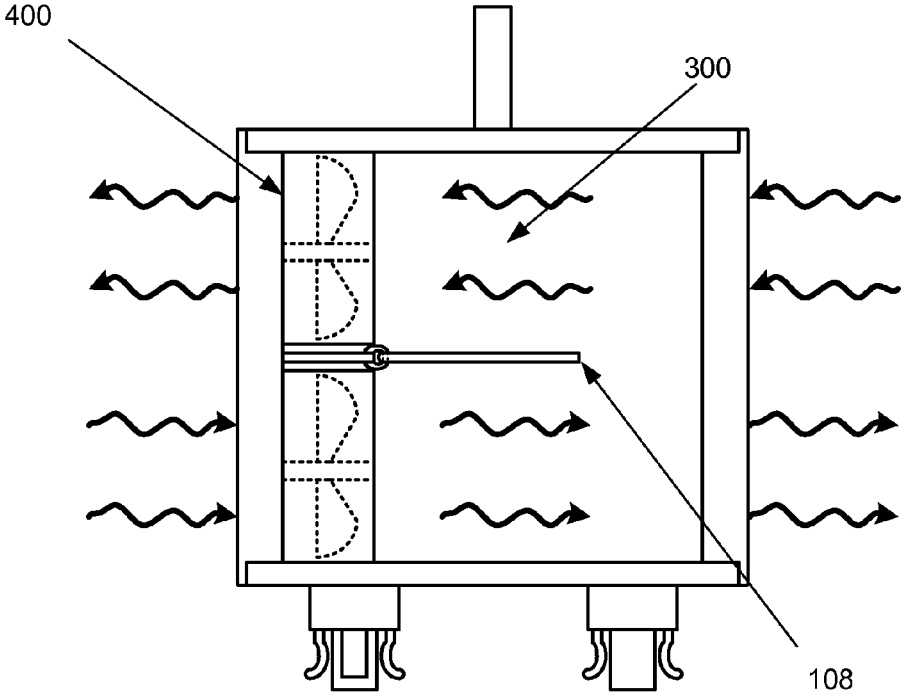
FIGS. 4A-B shows a reversible fan module in accordance with one or more embodiments of the invention.
Figure 4B:
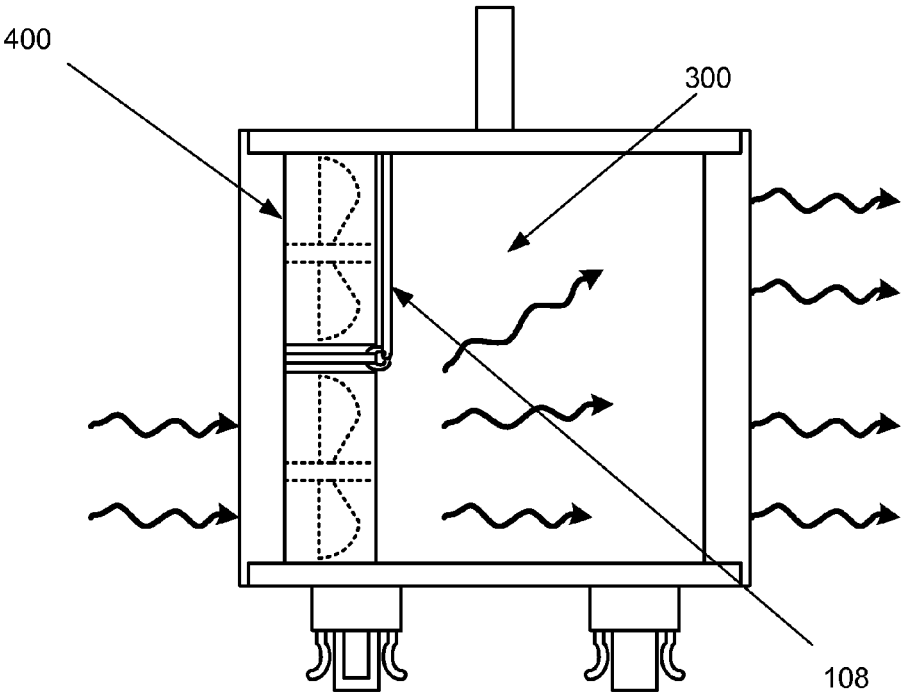

FIG. 4 shows the operation of the closing element (108) when a first fan unit is inactive (400). Specifically, FIG. 4A shows a top view of the reversible fan module (100) immediately after a first fan unit (400) becomes inactive and FIG. 4B shows a top view of the closing member (108) closing off the first housing airflow channel (300) in response to the inactivity of the first fan unit (400). As seen in FIG. 4A, when a first fan unit becomes inactive (400), immediately following the inactivity a counter airflow in the first housing airflow channel (300) may occur.

As seen in FIG. 4B, when a counter airflow occurs in the first housing airflow channel (300) the closing element (108) pivots into the first housing airflow channel (300) and closes it off. By closing off the first housing airflow channel (300), counter airflow is prevented.

Figure 5A:
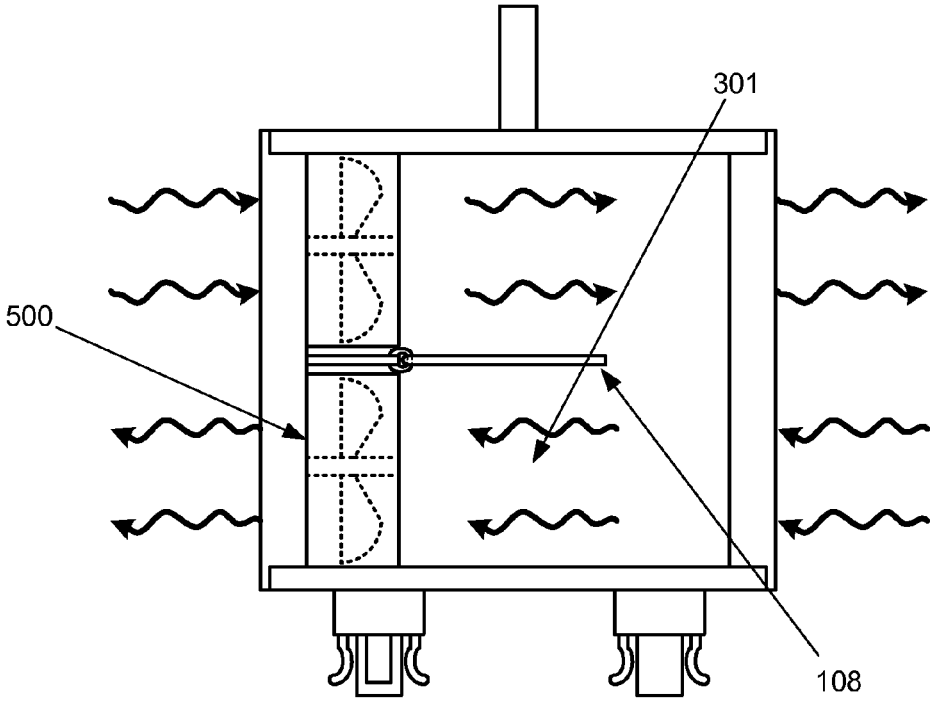
FIGS. 5A-B shows a layered two-dimensional material in accordance with one or more embodiments of the invention.
Figure 5B:
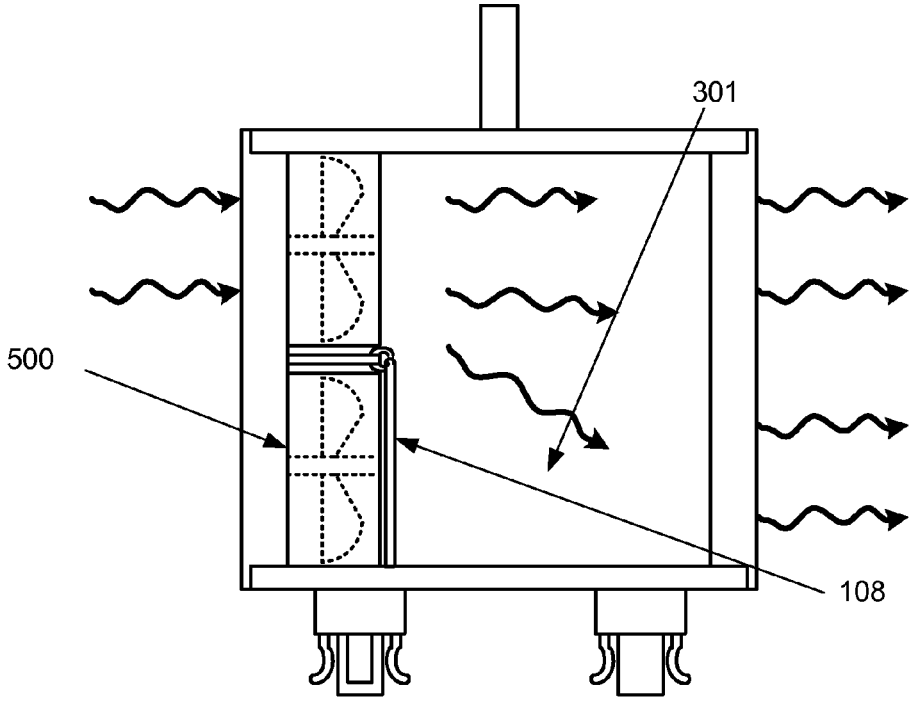

FIG. 5 shows the operation of the closing element (108) when a second fan unit is inactive (500). Specifically, FIG. 5A shows a top view of the reversible fan module (100) immediately after a second fan unit (500) becomes inactive and FIG. 5B shows a top view of the closing member (108) closing off the second housing airflow channel (301) in response to the inactivity of the second fan unit (500). As seen in FIG. 5A, when the second fan unit becomes inactive (500), immediately following the inactivity a counter airflow in the second housing airflow channel (301) may occur.

As seen in FIG. 5B, when the counter airflow occurs in the second housing airflow channel (301) the closing element (108) pivots into the second housing airflow channel (301) and closes it off. By closing off the second housing airflow channel (301), counter airflows are prevented. Thus, the closing element (108) enables multiple fan units (102) to operate as redundant backups without risking impairing the operation of the reversible fan module (100) in the event of inactivity of one of the fan units (102).

Figure 6:
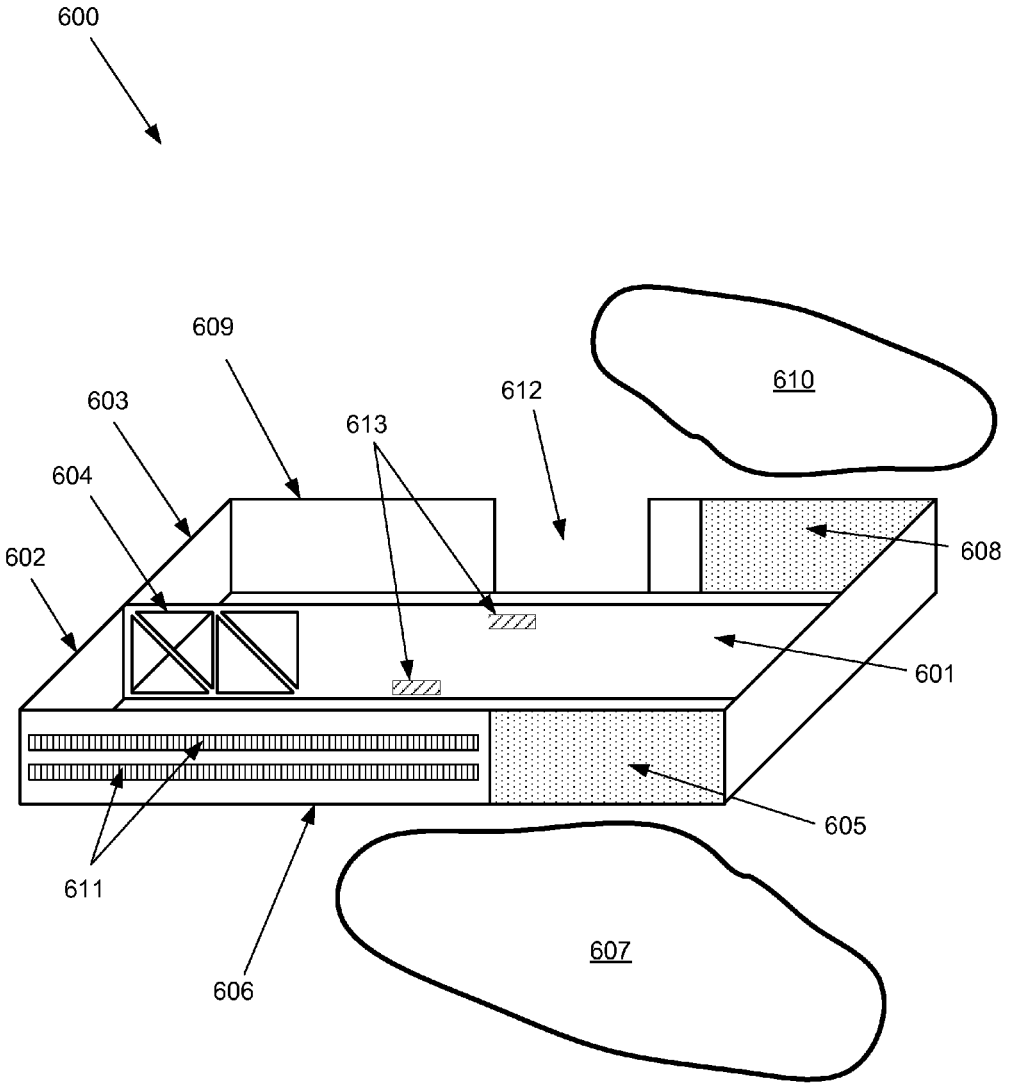
FIG. 6 shows a reversible fan module in accordance with one or more embodiments of the invention.

FIG. 6 shows an isometric view of a chassis (600) in accordance with one or more embodiments of the invention. In one or more embodiments, the chassis is used as part of a network switch. In one or more embodiments, the chassis may be used a housing for electrical components such as processors, memory, storage, power supplies, and cooling components. In one or more embodiments, the reversible fan module (100) is used as a cooling component within the network switch. The chassis (600) shown in FIG. 6 is configured to receive a reversible fan module (100) in two orientations. As discussed above, embodiments of the invention are not limited to a reversible fan module (100) having only two orientations. The chassis (600) and reversible fan module (100) may any number of orientations without departing from the invention.

The chassis (600) includes a dividing wall (601) that divides the internal space of the chassis (600) into a front compartment (602) and a rear compartment (603). The dividing wall (601) includes a window (604) that connects the front compartment (602) to the rear compartment (603). The window (604) is located near one of the ends of the dividing wall (601).

The chassis (600) also includes a first opening (605) on the front side of the chassis (606) that connects the front compartment (602) to a first external region (607). In one or more embodiments of the invention, the first external region (607) is a cold air aisle in a high density computing environment. In one or more embodiments, the first opening (605) is located as far from the window (604) as possible.

The chassis (600) further includes a second opening (608) on the rear side of the chassis (609) that connects the rear compartment (603) to a second external region (610). In one or more embodiments of the invention, the second external region (610) is a hot air aisle in a high density computing environment. In one or more embodiments, the second opening (608) is located as far from the window (604) as possible.

The chassis (600) also include a number of communication ports (611) disposed on the front side of the chassis (600). The communication ports (611) enable electronic components and systems within the chassis (600) to communicate with external communication networks or system.

The chassis (600) also includes a bay (612) adapted to receive a reversible fan module (100). The bay (612) opens to the second external region (610) for insertion and removal of the reversible fan module (100). The bay includes one or more attachment receptacles (613) disposed on the dividing wall (601). The attachment receptacles (613) are located and oriented to mate with the attachment members (106) on the reversible fan module (100). The attachment receptacles (613) are further adapted to position and orient the reversible fan module (100) in the bay (612). While the chassis (600) shown in FIG. 6 includes two attachment receptacles (613), embodiments of the invention include chassis (600) having a number of attachment receptacles (600) corresponding to the number of attachment members (106, FIG. 1).

Figure 7:
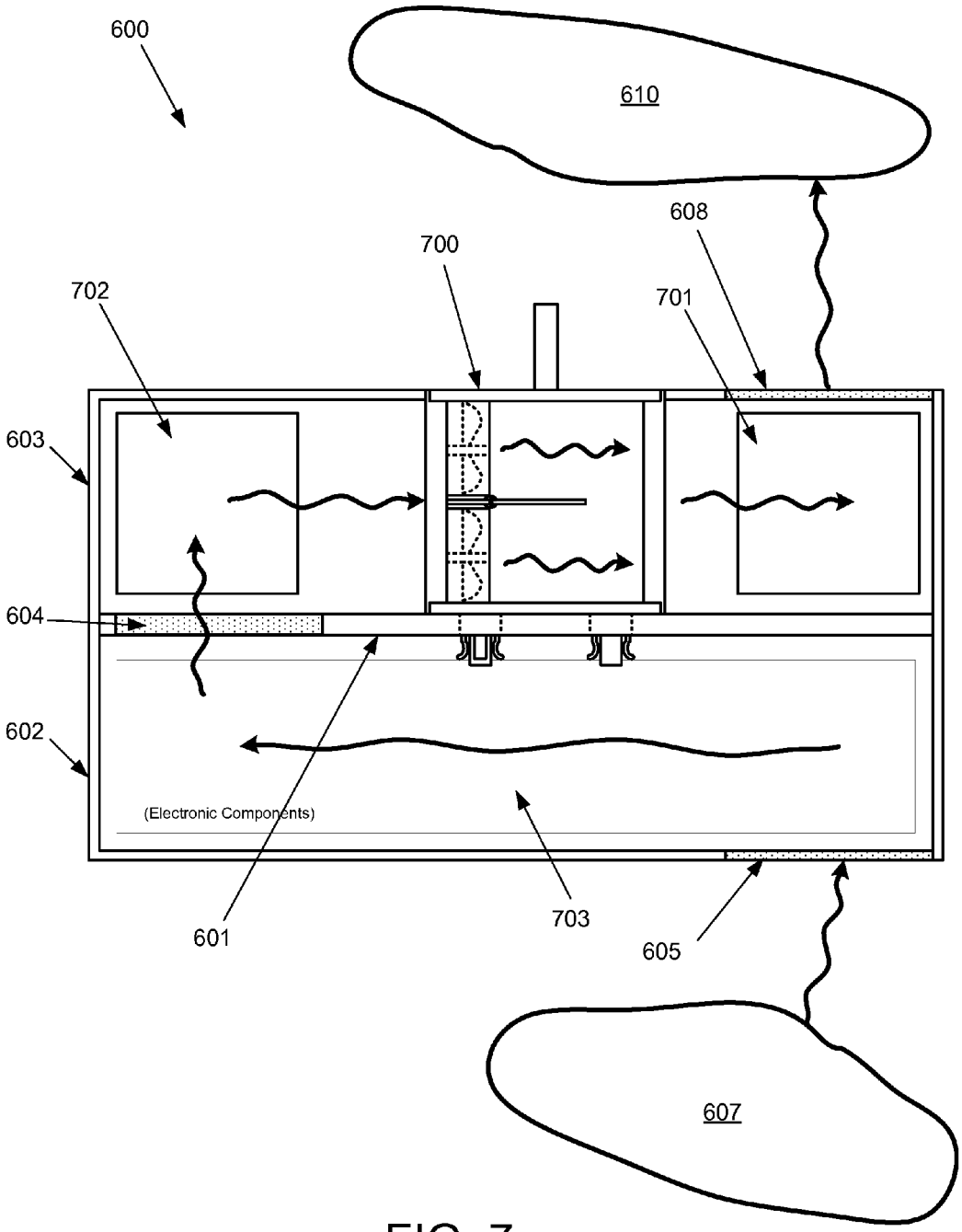
FIG. 7 shows a reversible fan module in accordance with one or more embodiments of the invention.

FIG. 7 shows a top view of the chassis in accordance with one or more embodiments of the invention. In addition to showing various features and components of the chassis (600), FIG. 7 also illustrates airflow within the chassis (600) when the reversible fan module (100) is in the bay (612) in a first orientation (700) and the fan units (102) are active. Airflow is indicated by arrows with wavy tails.

In one or more embodiments of the invention, the front compartment (602) houses a number of electrical communication and computation components (703). The communication and computation components (703) may be part of a network switch or any other type of communication device. In FIG. 7, the communication and computation component (703) are drawn as a box within the first compartment (602) for clarity.

In one or more embodiments of the invention, the second compartment (603) houses a first power supply (701) and a second power supply (702). The first power supply (701) and second power supply (702) are disposed on opposite sides of the bay. The first power supply (701) and second power supply (702) are adapted to be cooled by the reversible fan module (100). In one or more embodiments of the invention, neither power supply has its own active cooling element, e.g. a fan, and would overheat if left running without active cooling. The power supplies supply power to the reversible fan module (100) by a controller (not shown) when placed in the bay (612).

As seen from the arrows indicating air flow, when the reversible fan module (100) is in a first orientation (700), an airflow is created that is directed from the first external region (607), through the first opening (605), through the front compartment (602) and across the communication and computation components (703), through the window (604), into the rear compartment (702) and across the second power supply (702), through the reversible fan module (100), into the rear compartment (702) and across the first power supply (701), out of the second opening (608), and into the second external region (610). Thus, only a single airflow channel exists within the chassis (600). When the reversible fan module (100) is located in the bay (612) and active, the reversible fan module (100) generates an airflow that cools the communication and computation components (703) in the front compartment (602), the first power supply (701), and the second power supply (702). Without the airflow generated by the reversible fan module (600), the aforementioned components would overheat and cease to operate. The location of the first opening (605), second opening (608), and window (604) are chosen to create a single airflow path throughout the chassis (600) and, thereby enable cooling of all heat generating components within the chassis (100) by the reversible fan module (100).

Figure 8:
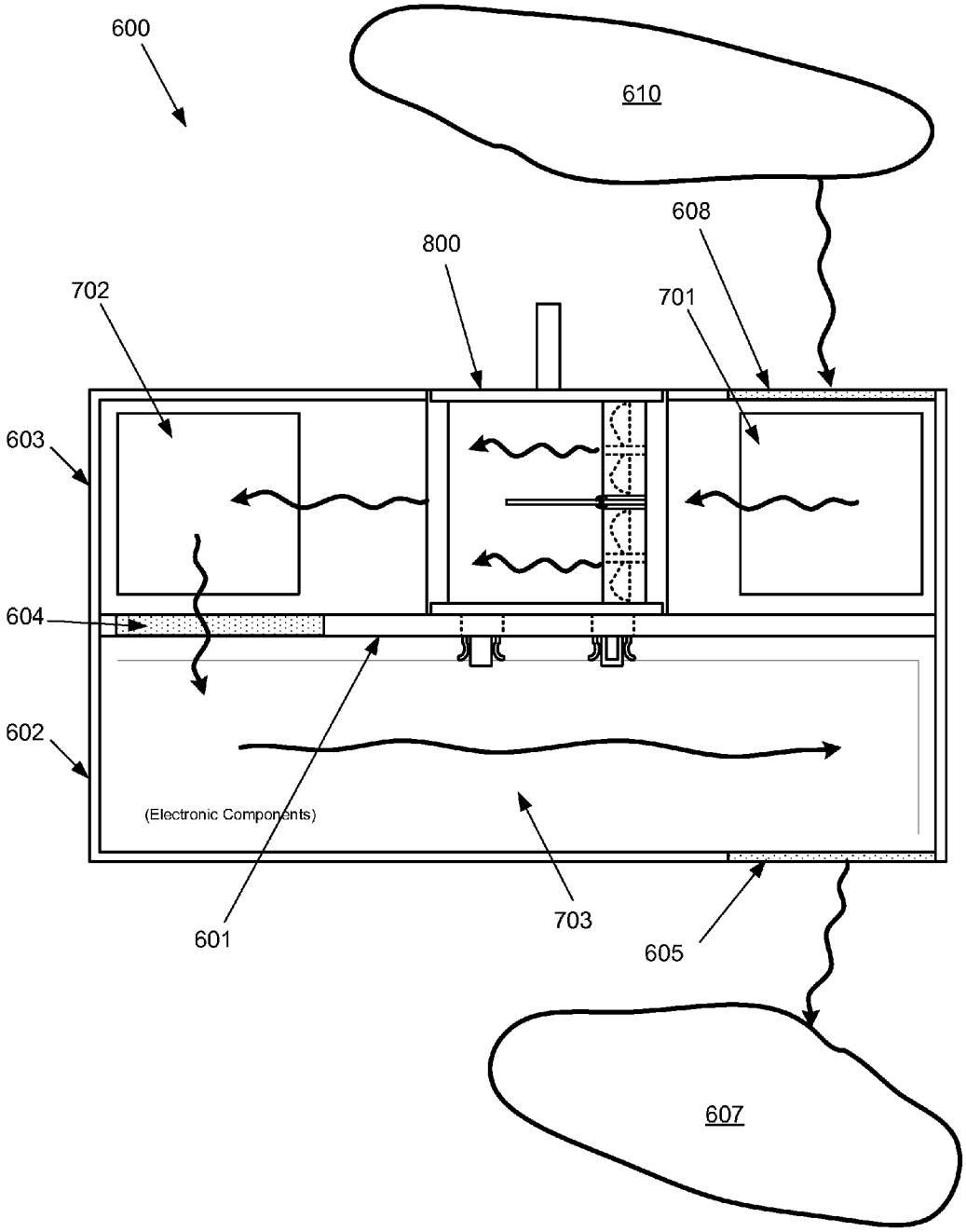
FIG. 8 shows a reversible fan module in accordance with one or more embodiments of the invention.

The airflow within the chassis (600) reverses direction when the orientation of the reversible fan module (100) is reversed. FIG. 8 shows a top view of the chassis (100) after reversing the orientation of the reversible fan module (100) in accordance with one or more embodiments of the invention. In addition to showing various features and components of the chassis (600), FIG. 8 also illustrates airflow within the chassis (600) when the reversible fan module (100) is in the bay (612) in a second orientation (800) and the fan units (102) are active. Airflow is indicated by arrows with wavy tails.

As seen from the arrows indicating air flow, when the reversible fan module (100) is in a second orientation (800), an airflow is created that is directed from the second external region (610), through the second opening (610), through the rear compartment (603) and across the first power supply (701), through the reversible fan module (100), through the rear compartment (702) and across the second power supply (702), through the window (604), through the front compartment (602), out of the first opening (605), and into the first external region (607). Thus, when in a second orientation (800), the reversible fan module (100) creates and airflow that cools the communication and computation components (703), first power supply (701), and second power supply (702).

Figure 9:
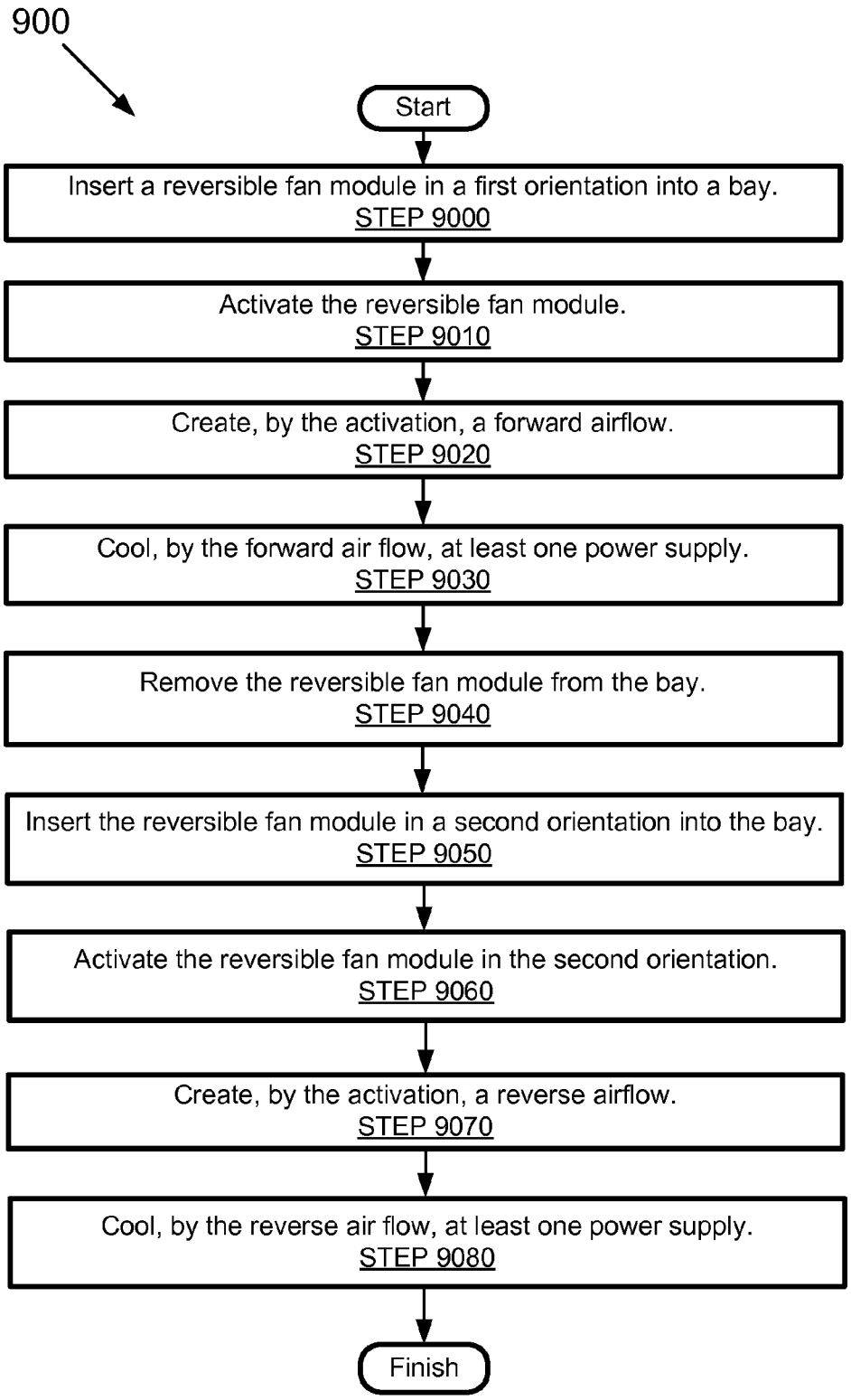
FIG. 9 shows a method in accordance with one or more embodiments of the invention.

FIG. 9 shows a flowchart (900) according to one or more embodiments of the invention. The method depicted in FIG. 9 may be used to reverse the flow of air in a chassis in accordance with one or more embodiments of the invention. One or more steps shown in FIG. 9 may be omitted, repeated, and/or performed in a different order among different embodiments.

At Step 9000, a reversible fan module (100) is inserted in a first orientation (700) in a bay (612) in a chassis (600). In one or more embodiments of the invention, insertion of the reversible fan module (100) connects the reversible fan module (100) to one or more power supplies housed in the chassis (600).

At Step 9010, the reversible fan module (100) is activated. Activation of the reversible fan module (100) causes the fan units (102) within the reversible fan module (100) to activate, which creates an airflow inside the reversible fan module (100

At Step 9020, an airflow within the chassis (600) is created in response to the activation of the reversible fan module (100). In one or more embodiments, the chassis (100) includes a single airflow path and the reversible fan module (100) is in-line with the path. In one or more embodiments of the invention, the created airflow is directed from the first external region (607), through the first opening (605), through the front compartment (602), and across the communication and computation components (703), through the window (604), into the rear compartment (702) and across the second power supply (702), through the reversible fan module (100), into the rear compartment (702) and across the first power supply (701), out of the second opening (608), and into the second external region (610).

At Step 9030, at least one power supply is cooled by the created airflow. In one or more embodiments, the created airflow cools a first power supply (701) and a second power supply (702). In one or more embodiments, neither the first power supply (701) nor the second power supply (702) include an active cooling element and would overheat in normal use unless cooled by an airflow created by the reversible fan module (100).

At Step 9040, the reversible fan module (100) is removed from the chassis (100). In one or more embodiments, removal of the reversible fan module (100) terminates an airflow within the chassis (100) that cools at least one power supply.

At Step 9050, the orientation of the reversible fan module (100) is reversed as shown in FIG. 2 and inserted into the bay (912) in the chassis (100) in a second orientation. In one or more embodiments of the invention, insertion of the reversible fan module (100) in the second orientation connects the reversible fan module (100) to one or more power supplies housed in the chassis (600).

At Step 9060, the reversible fan module (100) in the second orientation is activated. Activation of the reversible fan module (100) in the second orientation causes the fan units (102) within the reversible fan module (100) to activate which creates an airflow inside the reversible fan module (100).

At Step 9070, a reverse airflow within the chassis (600) is created in response to the activation of the reversible fan module (100) in the second orientation. In one or more embodiments of the invention, the created airflow is directed from the second external region (610), through the second opening (610), through the rear compartment (603) and across the first power supply (701), through the reversible fan module (100), through the rear compartment (702), and across the second power supply (702), through the window (604), through the front compartment (602), out of the first opening (605), and into the first external region (607).

At Step 9080, at least one power supply is cooled by the created reverse airflow. In one or more embodiments, the created reverse airflow cools a first power supply (701) and a second power supply (702). In one or more embodiments, neither the first power supply (701) nor the second power supply (702) include an active cooling element and would overheat in normal use unless cooled by the reverse airflow created by the reversible fan module (100) in the second orientation.

Figure 10:
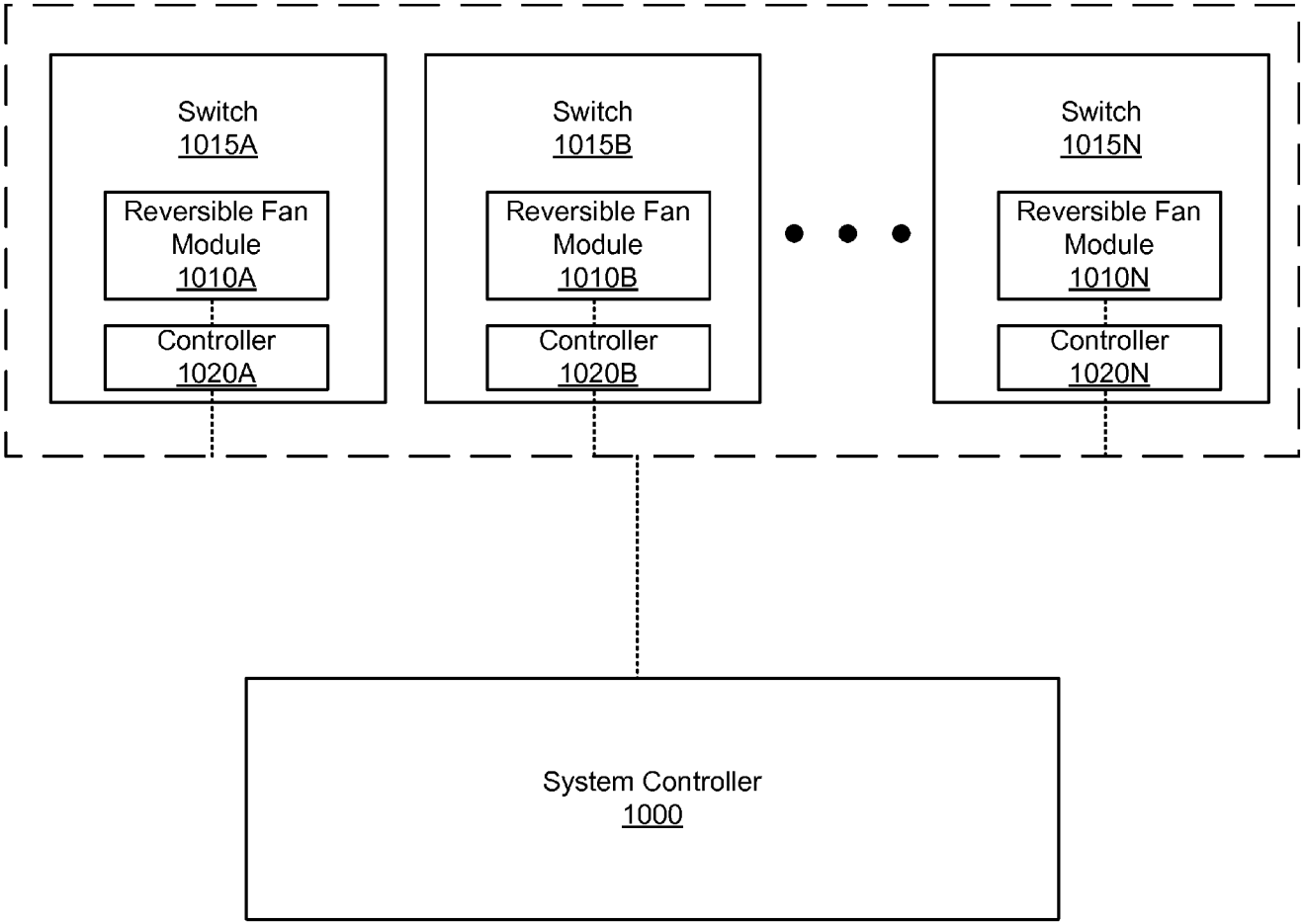
FIG. 10 shows a system in accordance with one or more embodiments of the invention.

FIG. 10 shows a system for controlling airflow according to one or more embodiments of the invention. The system includes a system controller (1000) and one or more network switches (1015A-1015N). Each network switch (1015A-1015N) includes a controller (1020A-1020N) and a reversible fan module (1010A-1010N). Each of the components is described below.

The system controller (1000) may be, for example, a server or other electronic control device. In one embodiment of the invention, a system controller (1000) is a physical device that may include persistent storage, memory (e.g., Random Access Memory), one or more processors, and a communication unit. The system controller (1000) may include instructions, stored within the persistent storage, to implement the functionality shown in FIG. 17.

The system controller (1000) is configured to communicate with controllers (1020A-1020N) through a communication interface by the communication unit. In one or more embodiments of the invention, the system controller (1000) and controller (1020) communicate via any wired and/or wireless connection and/or network. The system controller (1000) is configured to determine, based on a message received from a controller (1020), if an orientation of a reversible fan module is acceptable.

The system controller (1000) is configured to determine the acceptability of an orientation of a reversible fan module based on an identification of the controller (1000) and a code obtained from a reversible fan modules (1010A-1010N)) received in a message. The system controller (1000) may include (or obtain) a layout plan that includes the acceptable orientation of each reversible fan module (1010A-1010N) attached to each controller (1020A-1020N). The layout plan may include entries having the acceptable orientation of each reversible fan module (1010A-1010N). If the orientation of the reversible fan module (1010A-1010N)) does not match the layout plan, the system controller (1000) determines the orientation as unacceptable.

In one or more embodiments of the invention, the system controller (1000) may not include and may not be able to obtain a layout plan. If a layout plan is not available, the system controller (100) may determine the acceptability of an orientation of a reversible fan module based on a pattern of previously received codes associated with one or more reversible fan modules (1010A-1010N). In one embodiment of the invention, the orientation codes are associated with related network switches, where network switches are related when, e.g., they are in the same rack, they are in a different rack but in the same row racks as the other network switches, etc. For example, the system controller may identify that all of the previously received digital identities that have a first value, e.g., 1, 1, 1, 1, 1, 1, etc. This example pattern may indicate the reversible fan modules (1020A-1020N) are installed in a first orientation.

The system controller (1000) may be configured to compare the received code to the pattern. If the orientation of the reversible fan module (1010A-1010N) does not match the pattern, the system controller (1000) determines the orientation as unacceptable. For example, referring back to the prior exemplary pattern, if the system control receives an orientation code with a value of "0", then the system controller may determine that this particular reversible fan module is in an incorrect orientation.

In one or more embodiments of the invention, the system controller (1000) may be configured to send a message to a controller (1020A-1020N) indicating the acceptability of an orientation of a reversible fan module (1010A-1010N).

The system controller (1000) may be configured to send, to a controller (1020A-1020N), a minimum number of presence codes, based on the layout plan, in response to receiving a message from a controller (1020A-1020N). In one or more embodiments of the invention, the minimum number of presence codes may be the quantity of entries associated with the controller (1020A-1020N) in the layout plan. For example, the layout plan may include a number of entries corresponding to each controller (1020A-1020N). Based on the quantity of entries, the system controller (1000) may determine a minimum number of presence codes that are acceptable for a given controller. Thus, when a system controller (1000) receives a message from a controller (1020A-1020N) requesting the minimum number of presence codes, the system controller (1000) may identify the quantity of entries in the layout plan associated with the controller (1020A-1020N) and send a message indicating the minimum number of presence codes based on the quantity of associated entries.

In one or more embodiments of the invention, the minimum number of presence codes may be a fraction of the quantity of entries associated with the controller (1020A-1020N) in the layout plan. For example, the layout plan may include six entries a first controller (1020A). The system controller (1000) may determine that the minimum number of presence codes that are acceptable for a given controller is 50% of the number of entries and thus determine the minimum to be three. The system controller (1000) may send a message indicating the minimum number of presence codes is three. The fraction may be other than 50% without departing from the invention In one or more embodiments of the invention, a layout plan may not be available to the system controller (1000). If a layout plan is not available, the system controller (1000) may determine the minimum number of presence codes to be at least one. For example, a first controller (1020A) may request the minimum number of presence codes from the system controller (1000). If a layout plan is not available, the system controller (1000) may send a message indicating the minimum number of presence codes is one or another fixed quantity. The fixed quantity may be other than one without departing from the invention. Additional detailed regarding the use of presence codes is described in FIG. 18 below.

In one or more embodiments of the invention, the system includes a number of network switches (1015A-1015N). Each network switch (1015A-1015N) is a physical device that includes persistent storage, memory (e.g., Random Access Memory), one or more processors, and a communication unit. Each network switch (1015A-1015N) may include instructions, stored within the persistent storage, to implement the functionality shown in FIGS. 16A and 16B. Each network switch (1015A-1015N) may include a controller (1020A-1020N) and at least one reversible fan module (1010A-1010N). While the above discussion has been with reference to network switches, embodiments of the invention may be implemented on other network devices, e.g., multi-layer switches, routers, etc., without departing from the invention.

Each controller (1020A-1020B) includes a receptacle that attaches to one of multiple attachment members on a reversible fan module (1015A-1015B) to form an electrical connection between the controller and the reversible fan module.

In one or more embodiments of the invention, when a reversible fan module is attached to a controller (1020A-1020B), the controller (1020A-1020B) may provide power to the reversible fan module (1010A-1010N) when the reversible fan module (1010A-1010N) attaches to the controller. The controller is configured to read an orientation code from an attachment member that attaches to the controller (1020A-1020B). The controller (1020A-1020B) is configured to send the code along with the identity of the controller (1020A-1020B) to the system controller (1000). The controller (1020A-1020B) is configured to receive messages from the system controller (1000). The controller (1020A-1020B) is configured to terminate power transmission to the reversible fan module (1010A-1010N) in response to receiving a message from the system controller (1000) indicating that the orientation of the reversible fan module (1010A-1010N) is unacceptable.

In one or more embodiments of the invention, when a reversible fan module is attached to a controller (1020A-1020B), the controller is configured to read an orientation code from an attachment member that attaches to the controller (1020A-1020B) in order to obtain an orientation code. The controller (1020A-1020B) is configured to send the code along with the identity of the controller (1020A-1020B) to the system controller (1000). The controller (1020A-1020B) is configured to receive messages from the system controller (1000). The controller (1020A-1020B) is configured to initiate power transmission to the reversible fan module (1010A-1010N) in response to receiving a message from the system controller (1000) indicating the orientation of the reversible fan module (1010A-1010N) is acceptable.

In one or more embodiments of the invention, the controller (1020A-1020B) may be configured to obtain a minimum number of presence codes when the controller 1020A-1020N) starts up or initializes. The minimum number of presence codes may be stored locally on persistent storage of the controller (1020A-1020N) or may be stored on the system controller (1000). The controller (1020A-1020N) may be configured to obtain the minimum number of presence codes from the system controller (1000).

The controller (1020A-1020N) may be configured to monitor a number of presence codes read from one or more reversible fan modules (1010A-1010B) associated with the controller (1020A-1020N). If the number of presence codes is less than the minimum number of presence codes, the controller (1020A-1020B) may be configured to shut down the network switch (1015A-1015N) associated with the controller (1020A-1020N) after a predetermined period of time. The predetermined period of time may be, for example, 60 seconds. Additional detailed regarding the use of presence codes is described in FIG. 18 below.

Figure 11:
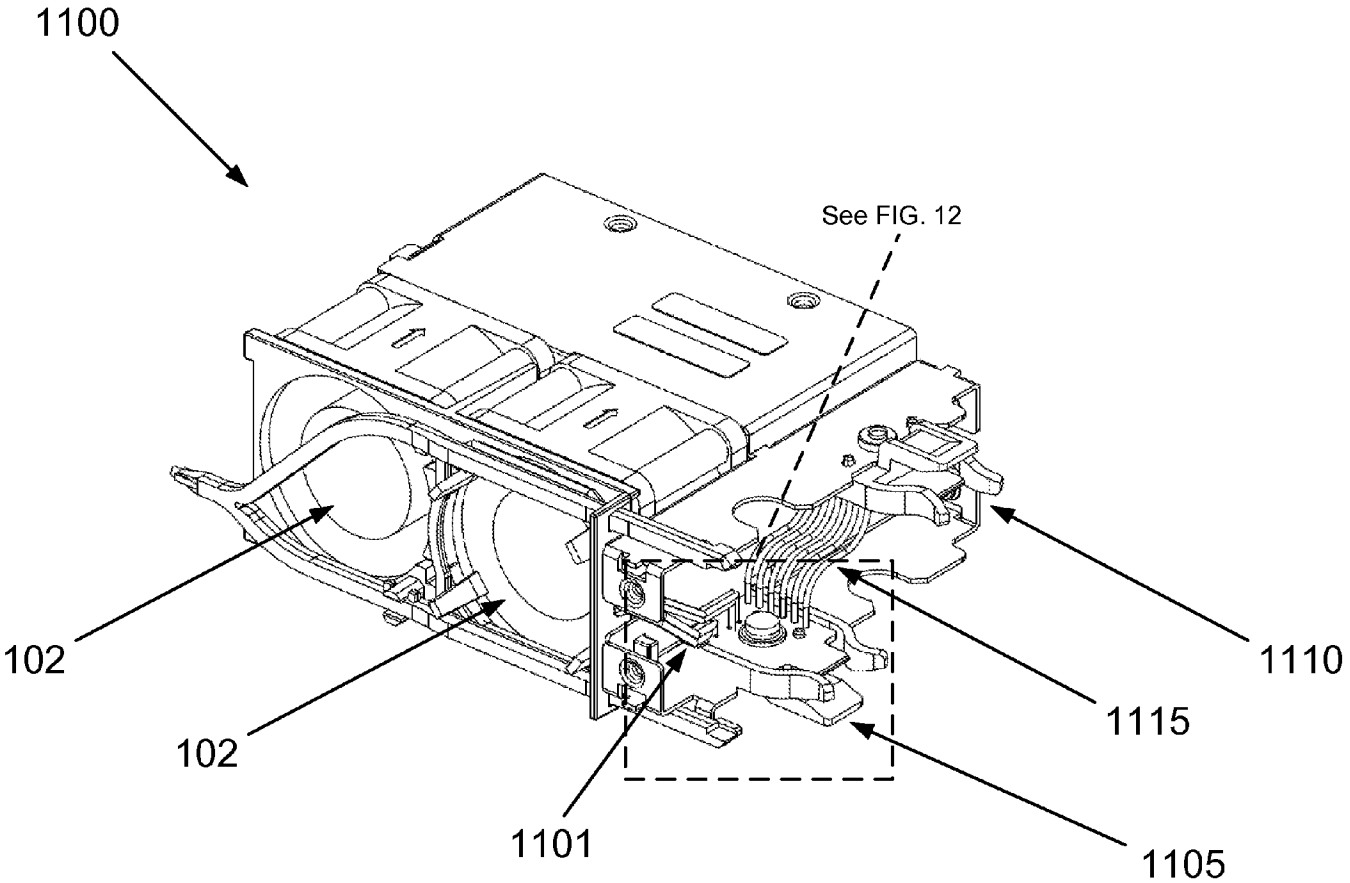
FIG. 11 shows a reversible fan module in accordance with one or more embodiments of the invention.

As discussed above, each network switch (1015A-1015N) includes at least one reversible fan module (1015A-1015B). FIG. 11 shows an example reversible fan module (1100) in accordance with one or more embodiments of the invention. The example reversible fan module (1100) includes a first attachment member (1105) and a second attachment member (1110). While the reversible fan module (1100) is illustrated as having two attachment members, a reversible fan module (1100) according to one or more embodiments of the disclosure may include any number of attachment members where each attachment member when attached to a controller in a chassis is associated with an orientation of the reversible fan module (1100) in the chassis.

The first attachment member (1105) and second attachment member (1110) are electrically connected by a number of wires (1115). The wires may be in the form of a ribbon cable or other form factor as would be known to one or ordinary skill in the art. The number of wires (1115) enable power to be transmitted from the second attachment member (1110) to the first attachment member (1105) when the second attachment member (110) is receiving power from the controller (not shown).

The first attachment member (1105) and fans (102) are connected by a second number of wires (1101). The wires may be any form factor as would be known to one or ordinary skill in the art. The second number of wires (1101) enable power to be transmitted from the first attachment member (1105) to the fans (102) when either the first attachment member (1105) or second attachment member (1110) are receiving power from the controller.

Figure 12:
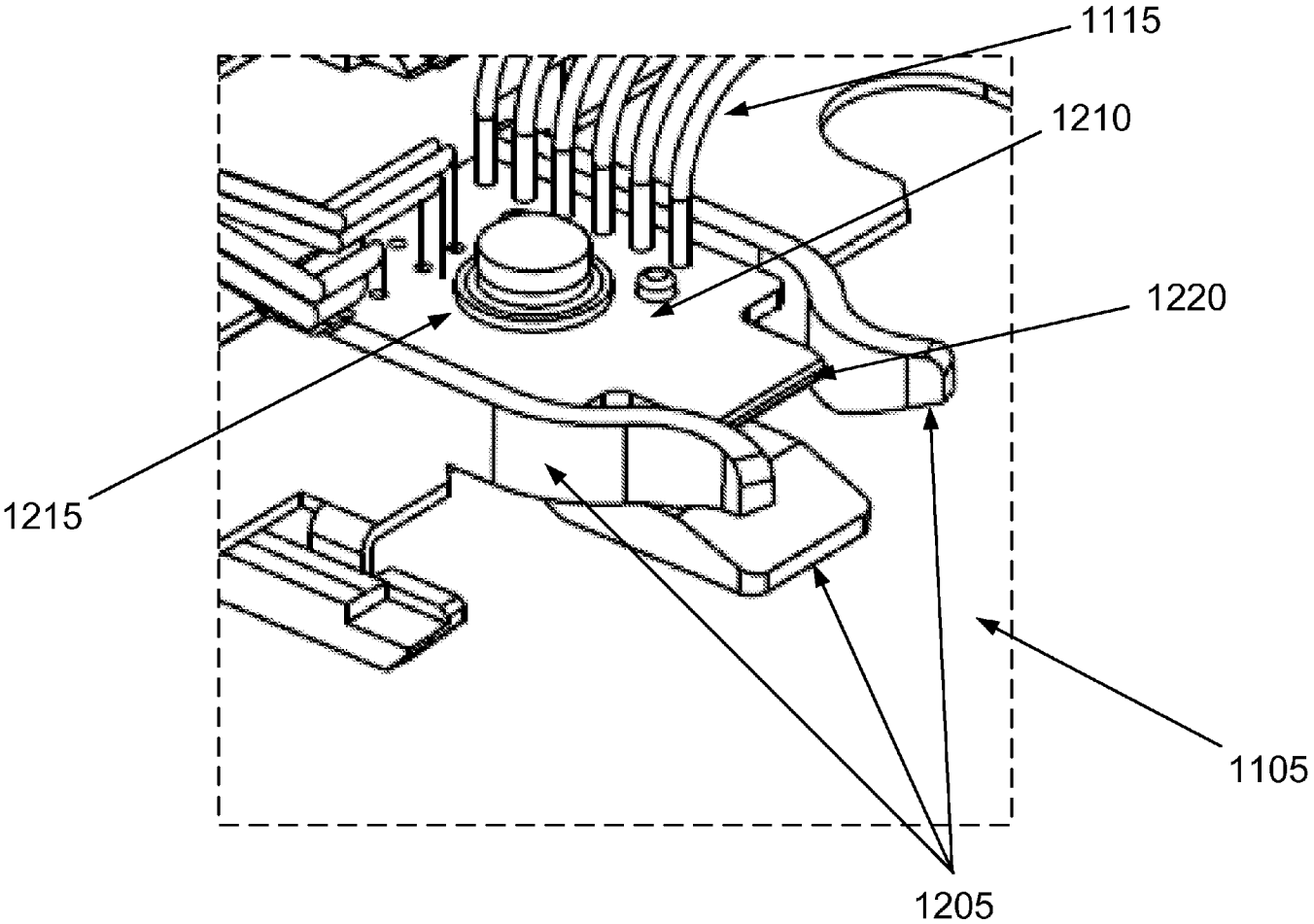
FIG. 12 shows a reversible fan module in accordance with one or more embodiments of the invention.

FIG. 12 shows an enlarged isometric view of the example reversible fan module in accordance with one or more embodiments of the invention. Specifically, FIG. 12 shows an enlarged view of the example first attachment member (1105). The first attachment member (1105) includes a mechanical attachment portion (1205). The mechanical attachment portion (1205) is configured to physically mate the first attachment member (1105) to the receptacle on the controller.

The first attachment member (1105) includes a circuit board (1210). The circuit board (1210) includes circuitry configured to receive power from either the controller or the second attachment member (1110). The circuitry may also be configured to send and receive control and feedback signals to the controller (not shown). The circuit board also includes a number of pads (1220) configured to mate with a number of corresponding pads on the receptacle of the controller to form an electrical connection between the controller and the first attachment member (1105).

The circuit board (1210) include an orientation code. The orientation code is configured to be read by a controller. The orientation code may be passive circuitry, such as a number of resistors or active circuitry such as non-transitory memory device storing binary information. For example, the resistors may be arranged to provide a resistance corresponding to a bit code. In another example, the non-transitory memory device may be an erasable programmable read only memory (EPROM) chip storing a bit code. The bit code corresponds to the orientation of the reversible fan module when the attachment member is attached to the receptacle.

The circuit board (1210) may include a presence code. The presence code is configured to be read by a controller. The presence code may be passive circuitry, such as a number of resistors or active circuitry such as non-transitory memory device storing binary information. For example, the resistors may be arranged to provide a resistance corresponding to a bit code. In another example, the non-transitory memory device may be an erasable programmable read only memory (EPROM) chip storing a bit code. The bit code corresponds to the presence of the reversible fan module when the attachment member is attached to the receptacle.

The circuit board (1210) is connected to the mechanical attachment portion (1205) by a bolt (1215) or other physical means as would be known to one of ordinary skill in the art. The bolt (1215) also forms an electrical connection with the reversible fan module (1100) to the controller and therein grounds the reversible fan module (1100) to the controller when disposed in the chassis, e.g., a ground line from the controller contacts the bolt (1215) by the circuit board (1210) and the bolt (1215) contacts the body of the reversible fan module (1100). In one or more embodiments of the invention, the bolt (1215) may reduce the potential for electro-static discharge by providing a path to ground for charges that may accumulate on the reversible fan module (1100). In one or more embodiments of the invention, the bolt (1215) may reduce electromagnetic interference by reducing the ground loop impedance when compared to a reversible fan module (1100) that does not include a bolt (1215) or other grounding structure.

The second attachment member (1110) includes mechanical and electrical features similar to the first attachment member (1105). However, the second attachment member (1110) includes a different digital identifier and therein distinguishes the second attachment member (1110) from the first attachment member (1105) to the controller.

While the example reversible fan module shown in FIGS. 11 and 12 has been illustrated as having two attachment members (1105, 1110), embodiments of the invention are not limited to only two attachment members. Embodiments of the include fan modules having numbers of attachment members corresponding to the number of potential orientations of the fan module within the chassis. For example, a fan module according to one or more embodiments of the invention may include three attachment members and may be placed within a chassis in three orientations. In each of the orientations, the location and orientation of each attachment member are configured to mate one of the attachment members with a receptacle on the controller and therein connect to the fan module to the system.

Figure 13:
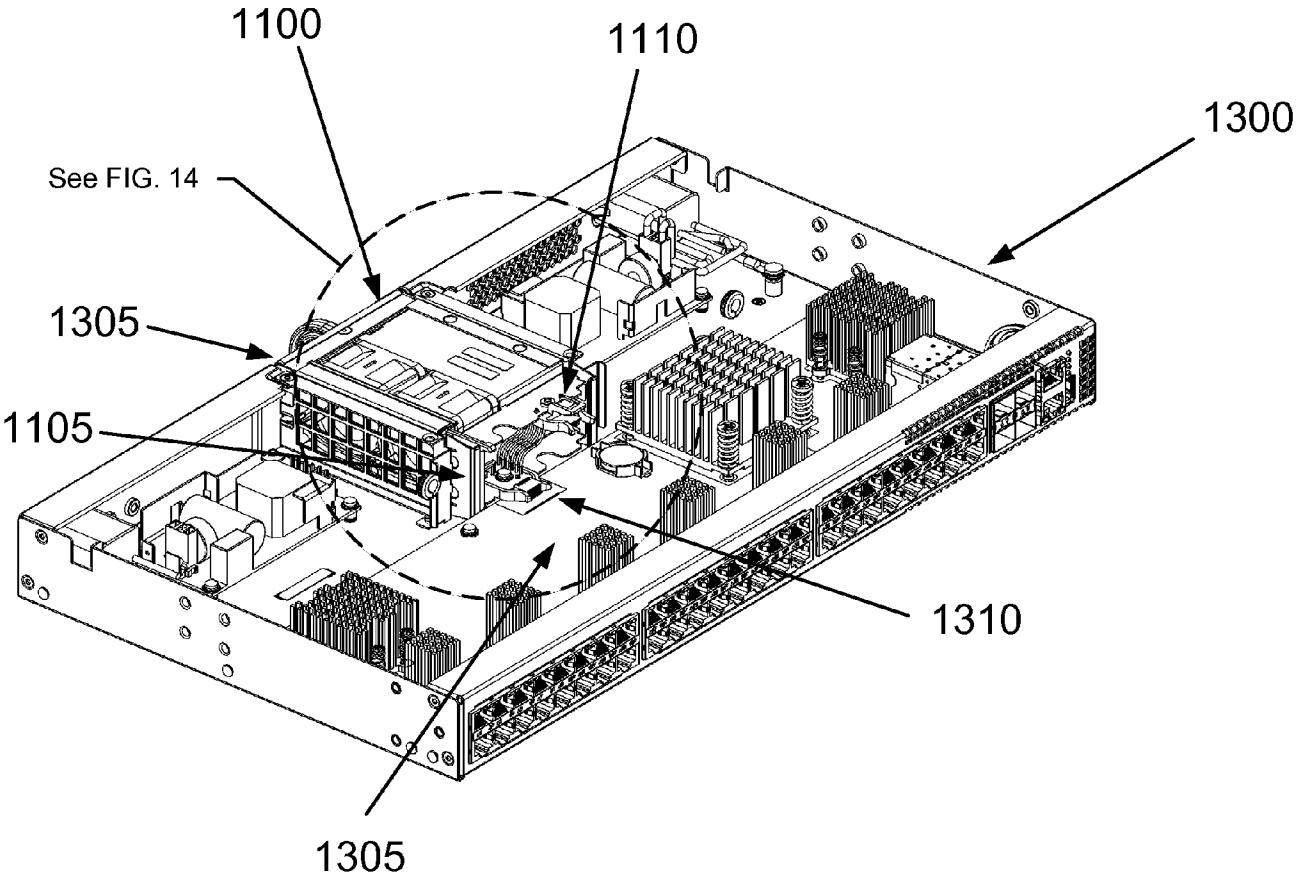
FIG. 13 shows a reversible fan module in a chassis in accordance with one or more embodiments of the invention.

FIG. 13 shows an isometric view of the example reversible fan module (1100) disposed in a chassis (1300) in accordance with one or more embodiments of the invention. The chassis (1300) includes a bay (1305) configured to receive the reversible fan module (1100) in a first orientation or a second orientation.

Figure 14:
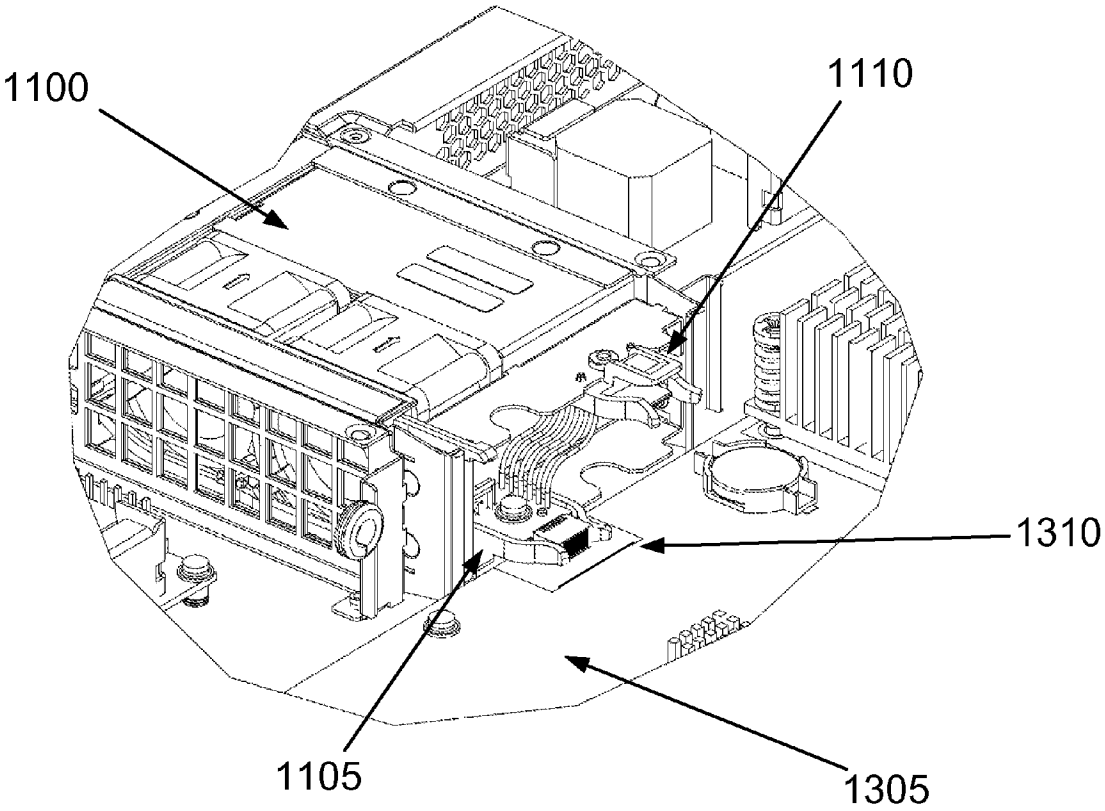
FIG. 14 shows a reversible fan module in a chassis in accordance with one or more embodiments of the invention.
Figure 15:
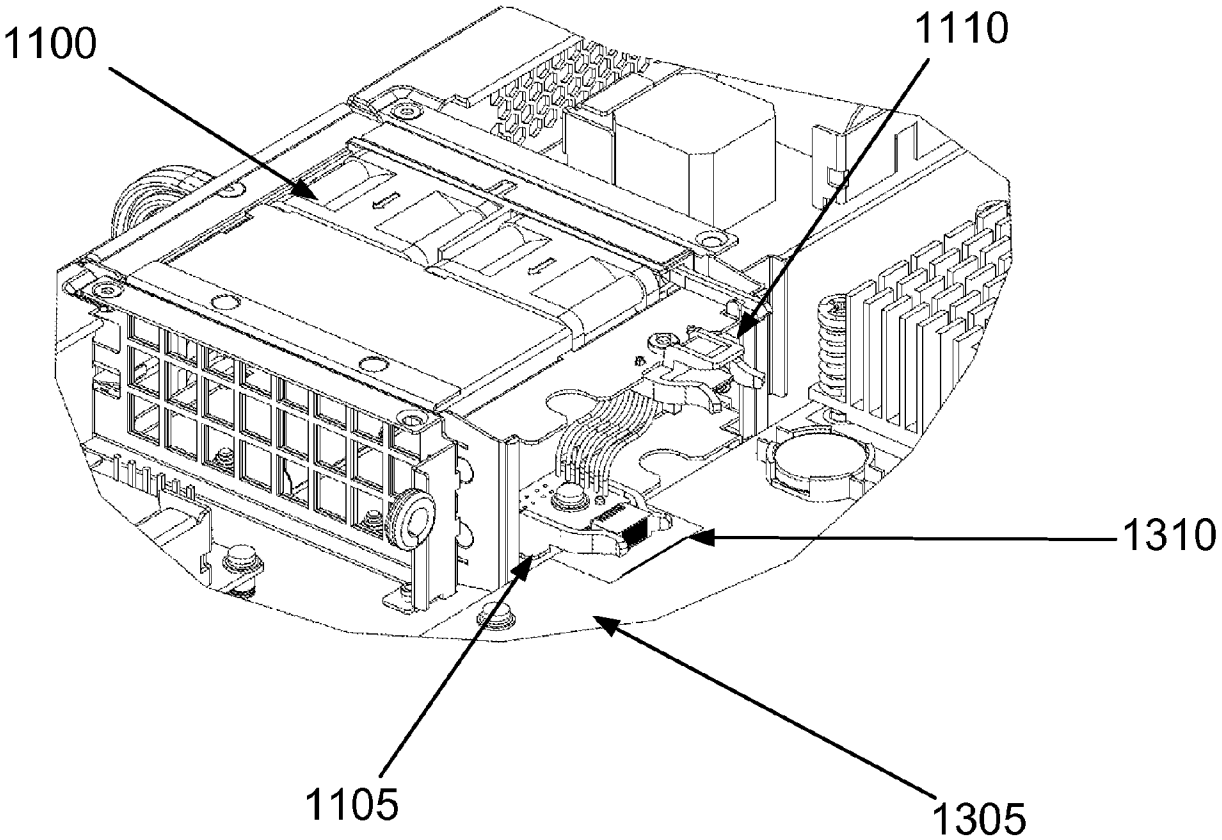
FIG. 15 shows a reversible fan module in a chassis in accordance with one or more embodiments of the invention.

The reversible fan module (1100) is connected to a controller (1305), disposed within the chassis (1300). The reversible fan module (1100) is connected to the controller (1305) by the receptacle (1310). An electrical connection is formed between an attachment member and the receptacle (1310), depending on the orientation of the reversible fan module. In this example, the first attachment member (1105) is connected to the controller (1305) by the receptacle (1310). A mechanical connection and electrical connections between the controller (1305) and the reversible fan module (1100) is made by the connection. FIGS. 14 and 15 show isometric view of those connections.

FIG. 14 show an isometric view of the connection between the reversible fan module (1100) and the controller (1305) when the reversible fan module (1100) is in a first orientation in accordance with one or more embodiments of the invention. As seen from FIG. 14, when the first attachment member (1105) is attached to the receptacle (1310) electrical and mechanical connections are formed between the controller (1305) and the first attachment member (1105). These connections may support power transmission, reading of the orientation code and/or presence code, and sending and receiving control and feedback signals to the controller (1305) as discussed above.

FIG. 15 show an isometric view of the connection between the reversible fan module (1100) and the controller (1305) when the reversible fan module (1100) is in a second orientation in accordance with one or more embodiments of the invention. As seen from FIG. 15, when the second attachment member (1110) is attached to the receptacle (1310) electrical and mechanical connections are formed between the controller (1305) and the second attachment member (1110). These connections may support power transmission, reading of the orientation code and/or presence code, and sending and receiving control and feedback signals to the controller (1305) as discussed above.

Figure 16A:
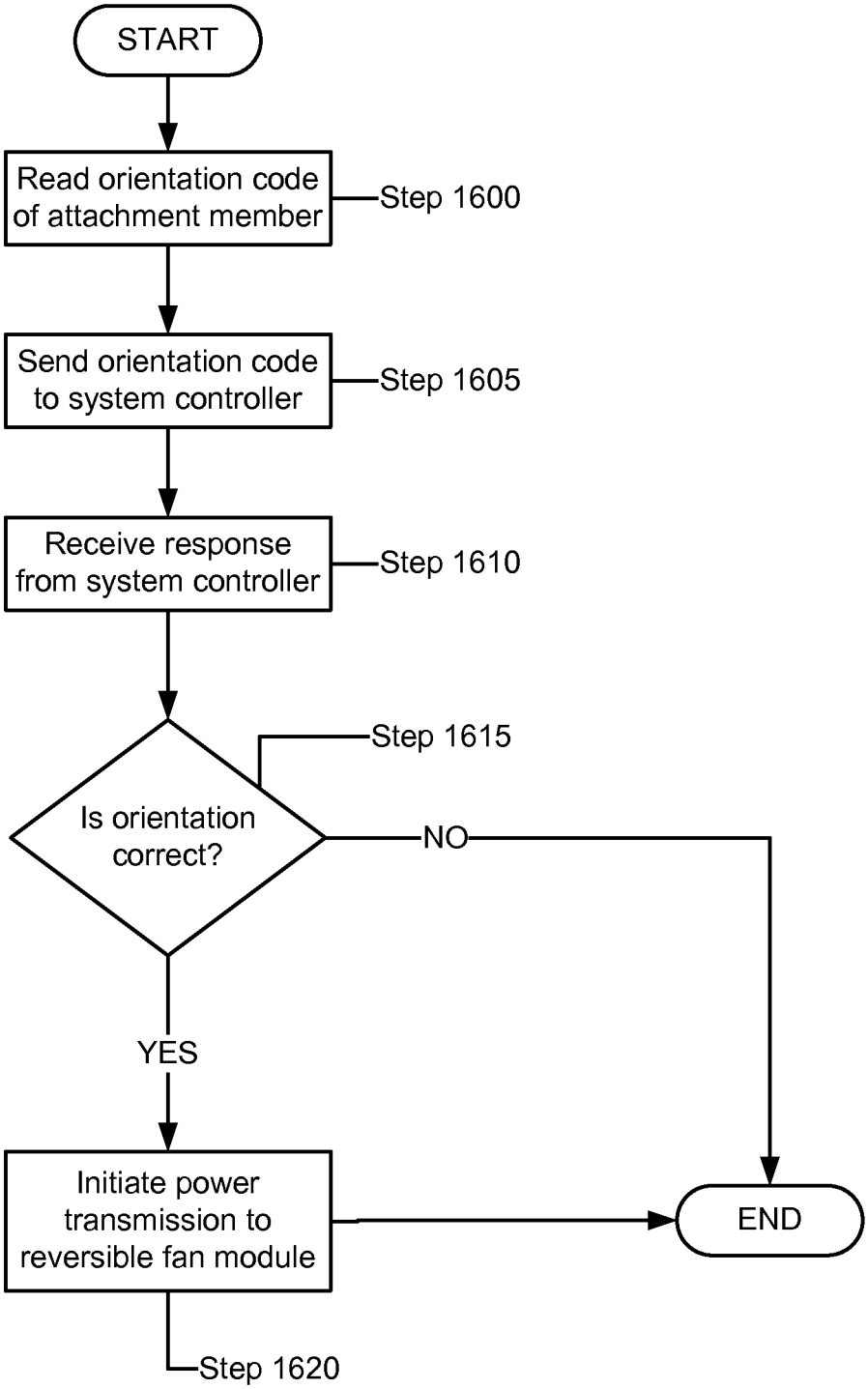
FIG. 16A shows a method in accordance with one or more embodiments of the invention.

FIG. 16A shows a flowchart according to one or more embodiments of the invention. The method depicted in FIG. 16A may be used to supply power to a reversible fan module by a controller in accordance with one or more embodiments of the invention. One or more steps shown in FIG. 16A may be omitted, repeated, and/or performed in a different order among different embodiments.

At Step 1600, the orientation code of an attachment member is read by a controller in order to obtain an orientation code. As discussed above, a reversible fan module may be inserted into a chassis of a network switch or other networking device. When a reversible fan module is inserted, a connection is made between an attachment member on the reversible fan module and a receptacle on a controller as illustrated by, for example, FIG. 14. Upon connection of the attachment member and the receptacle, an electrical connection between the reversible fan module and the controller is formed. Once the reversible fan module receives power, the controller may obtain the aforementioned code from the reversible fan module where the orientation code indicates the current orientation of the reversible fan module. The power provided in step 1600 may only be sufficient to permit the controller to obtain the orientation code but not to power the fan(s) within the reversible fan module.

At Step 1605, the code is sent to a system controller, by the controller, along with the identity of the controller. For example, as shown in FIG. 10, the controller may be connected to the system controller by an interface. The controller may send both the code and the identity of the controller to the system controller via the interface.

Returning, to FIG. 16A, at Step 1610, the controller may receive a message from the system controller indicating if the orientation of a reversible fan module is acceptable. If the controller does not receive a response from the system controller within a predetermined period of time, the method may end and, in particular, no additional power may be provided to the reversible fan module.

At Step 1615, if the message received from the system controller indicates the orientation of the reversible fan module is acceptable, then the method proceeds to Step 1640. Otherwise the method ends. More specifically, no additional power is provided to the reversible fan module.

At Step 1620, the controller initiates power transmission to the reversible fan module. More specifically, the reversible fan module is properly oriented and, as such, power provided in order to permit operation of the fan(s) in the reversible fan module.

Figure 16B:
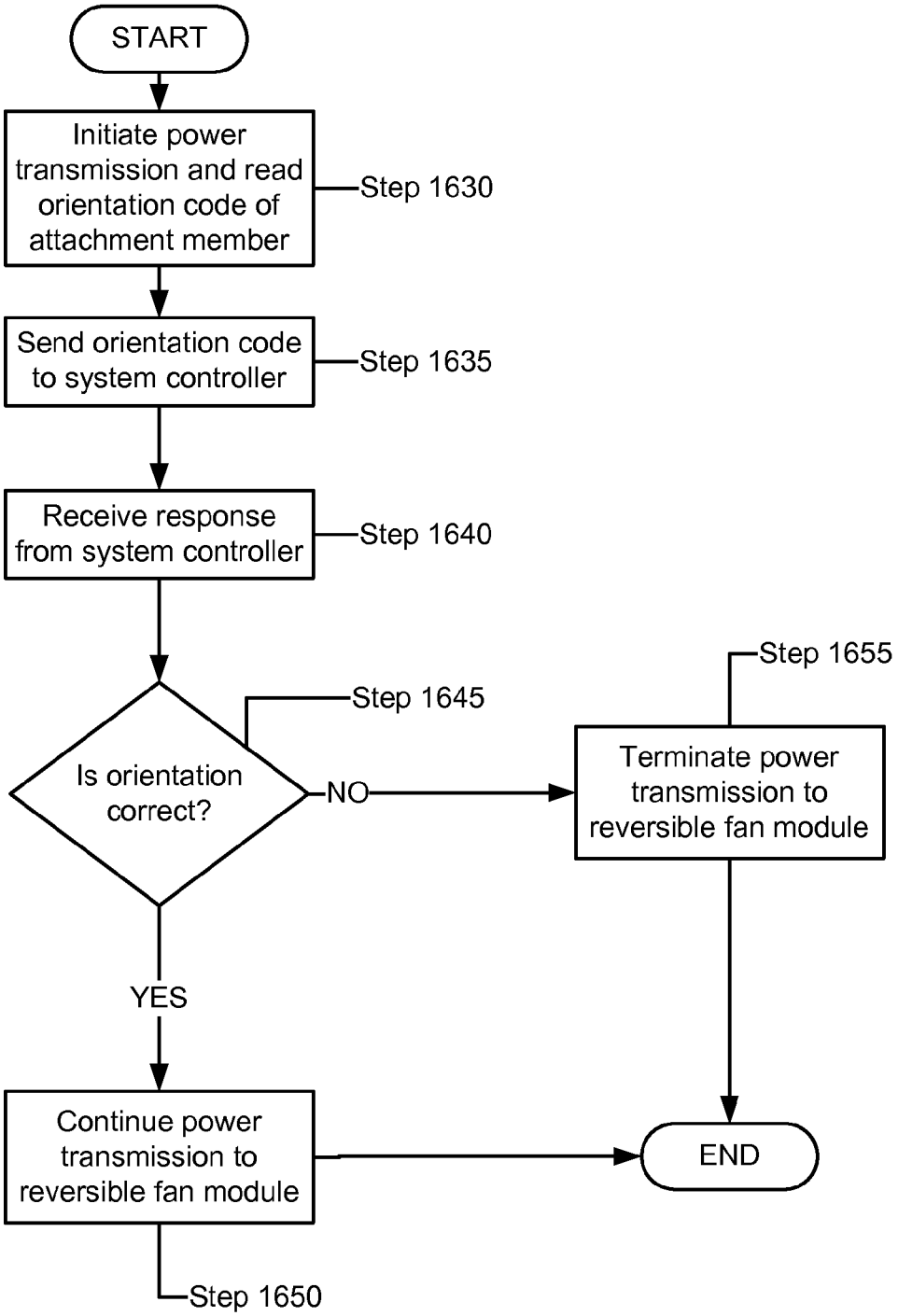
FIG. 16B shows a method in accordance with one or more embodiments of the invention.

FIG. 16B shows a flowchart according to one or more embodiments of the invention. The method depicted in FIG. 16*b* may be used to supply power to a reversible fan module by a controller in accordance with one or more embodiments of the invention. One or more steps shown in FIG. 16B may be omitted, repeated, and/or performed in a different order among different embodiments.

At Step 1630, a controller of a network switch initiates power transmission to a reversible fan module and reads the orientation code (discussed above). As discussed above, a reversible fan module may be connected to the controller by an electrical connection through the attachment member. The controller may transmit power to the reversible fan module and read (or otherwise obtain) the orientation code from the reversible fan module.

At Step 1635, the controller sends the code to a system controller along with the identity of the controller. For example, as shown in FIG. 10, the controller may be connected to the system controller by an interface. The controller may send both the code and the identity of the controller to the system controller via the interface.

Returning, to FIG. 16B, at Step 1640, the controller may receive a message from the system controller indicating if the orientation of a reversible fan module is acceptable. If the controller does not receive a response from the system controller within a predetermined period of time, the controller may proceed to Step 1655.

At Step 1645, if the message received from the system controller indicates the orientation of the reversible fan module is acceptable, then the method proceeds to Step 1650. Otherwise the method proceeds to Step 1655.

At Step 1650, the controller continues the power transmission to the reversible fan module.

At Step 1655, the controller terminates the power transmission to the reversible fan module. In other words, the controller terminates the power transmission initiated in Step 1630 if the system controller indicates the orientation of the reversible fan module is unacceptable.

While FIGS. 16A and 16B have been described with respect to a controller of a network switch, embodiments shown in FIGS. 16A and 16B may be implemented by other network devices without departing from the invention.

Figure 17:
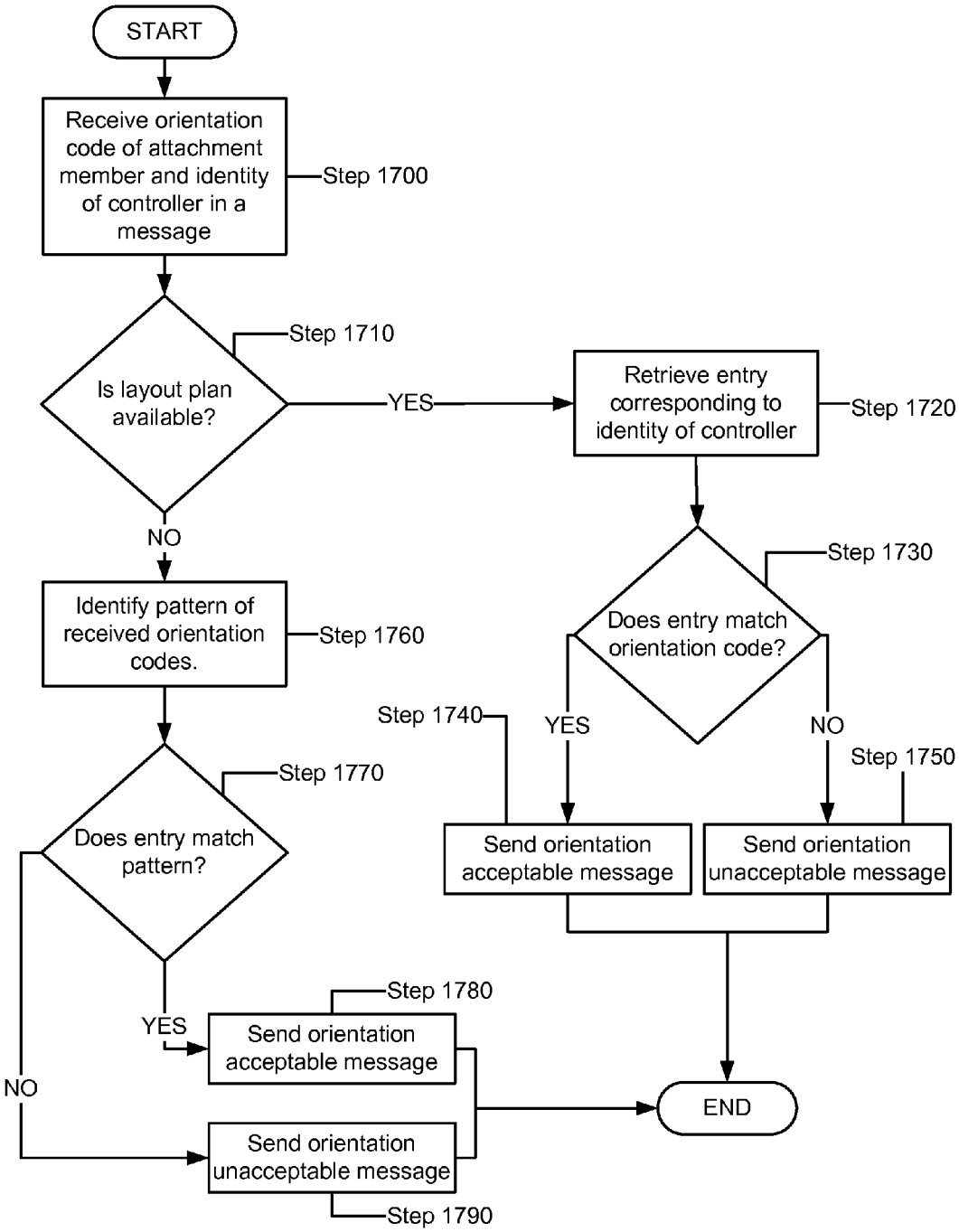
FIG. 17 shows a method in accordance with one or more embodiments of the invention.

FIG. 17 shows a flowchart according to one or more embodiments of the invention. The method depicted in FIG. 17 may be used to supply power to a reversible fan module in accordance with one or more embodiments of the invention. One or more steps shown in FIG. 17 may be omitted, repeated, and/or performed in a different order among different embodiments.

In Step 1700, a system controller receives a message from a controller of a network switch. The message includes a digital identity of an attachment member of a reversible fan module and the identity of the controller of the network switch.

In Step 1710, a determination is made about whether a layout plan is available. If a layout plan is available, the method proceeds to Step 1720; otherwise, the method proceeds to Step 1760.

In Step 1720, the system controller obtains an entry from the layout plan corresponding to the identity of the controller of the network switch.

In Step 1730, if the digital identity of the attachment member matches the acceptable orientation of the reversible fan module, the method proceeds to Step 1740; otherwise, the method proceeds to Step 1750.

In Step 1740, the system controller sends a message to the controller of the network switch indicating the orientation of the reversible fan module is acceptable.

In Step 1750, the system controller sends a message to the controller of the network switch indicating the orientation of the reversible fan module is unacceptable.

Returning to step 1710, when a determination is made that a layout plan is not available, then the process may proceed to step 1760. In Step 1760, the system controller identifies a pattern of received codes. Identification of patterns by the system controller is further clarified by way of an example.

For example, the system controller may identify that all of the previously received code have an identical value. This may indicate that all of the previously installed reversible fan modules are installed in the same orientation.

In Step 1770, if the code of the attachment member matches the identified pattern (or is otherwise expected based on the identified pattern), then the method proceeds to Step 1780. Otherwise the method proceeds to Step 1790.

In Step 1780, the system controller sends a message to the controller of the network switch indicating the orientation of the reversible fan module is acceptable.

In Step 1790, the system controller sends a message to the controller of the network switch indicating the orientation of the reversible fan module is unacceptable.

Figure 18:
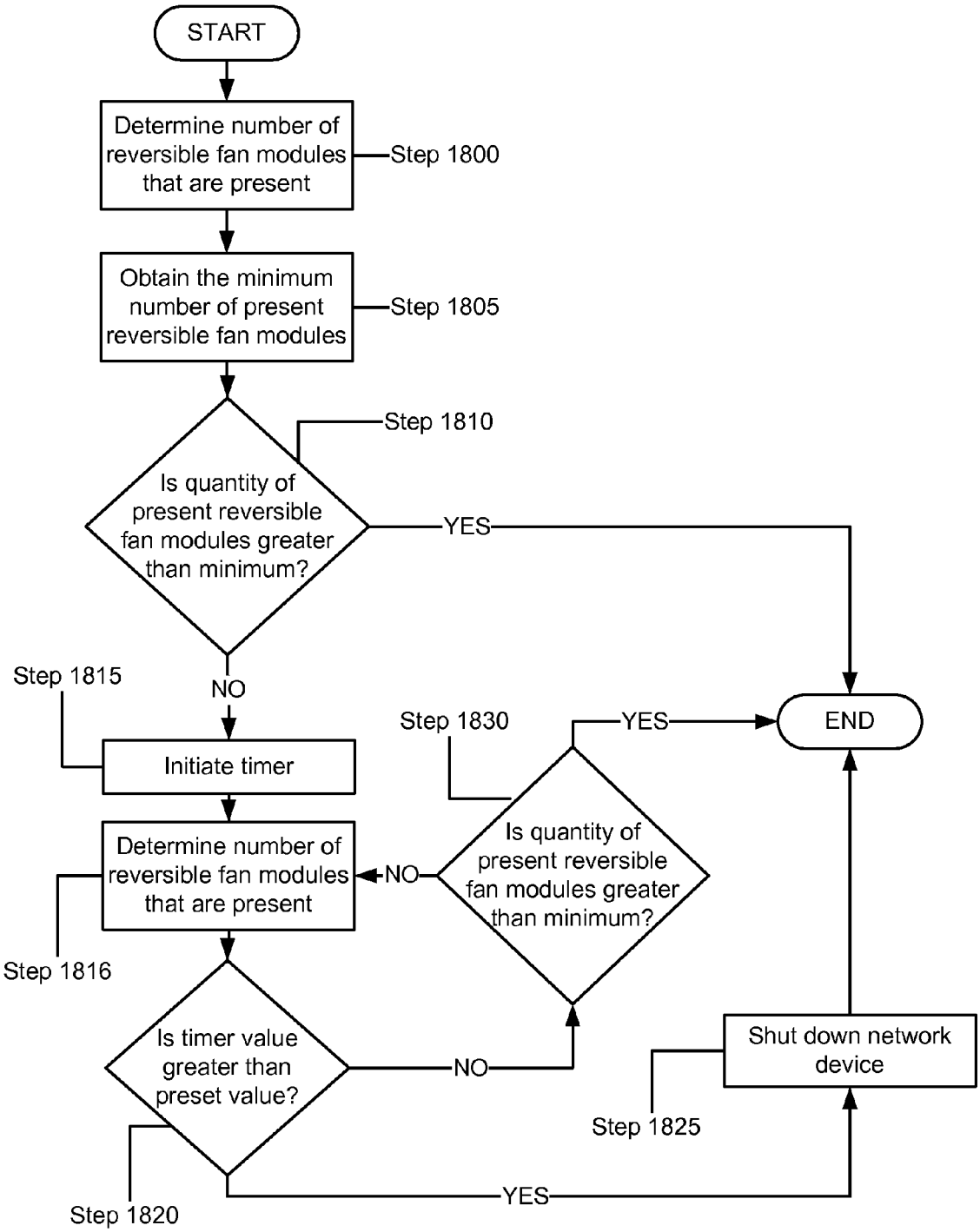
FIG. 18 shows a method in accordance with one or more embodiments of the invention.

FIG. 18 shows a flowchart according to one or more embodiments of the invention. The method depicted in FIG. 18 may be used to supply power to a reversible fan module in accordance with one or more embodiments of the invention. One or more steps shown in FIG. 18 may be omitted, repeated, and/or performed in a different order among different embodiments.

In Step 1800, a controller determines the number of reversible fan modules attached to the controller, e.g., the number of reversible fan modules that are present. As discussed above, fan modules may include attachment members that attach to receptacles on the controller. Each attachment member may include a presence code that may be read by the controller when attached to a receptacle. The presence code identifies the presence of the reversible fan module to the controller. Thus, by reading each presence code of each reversible fan module attached to the controller, the controller may determine the quantity of reversible fan modules that are present.

The presence code may be, for example, a digital code such as a four bit binary number. The binary code 0001 may, for example, indicate the reversible fan module is present. Thus, the controller, upon reading a presence code of 0001 may determine that the associated reversible fan module is present.

In Step 1805, the controller obtains the minimum number of present reversible fan modules. The minimum number of present reversible fan modules may be stored locally on a persistent storage of the controller or may be stored on a system controller. If the minimum number of present reversible fan modules is stored on a system controller, the controller may send messages to the system controller requesting the minimum number of present reversible fan modules and may receive a response from the controller indicating the minimum number of present reversible fan modules.

In Step 1810, if the quantity of present reversible fan modules is greater than the retrieved minimum number of present reversible fan modules, the method ends; otherwise, the method proceeds to Step 1815.

In Step 1815, a timer of the controller is initiated and begins counting time.

In Step 1816, the controller determines the number of reversible fan modules attached to the controller.

In Step 1820, if the timer value is greater than a preset value, the method proceeds to Step 1825; otherwise, the method proceeds to Step 1830. As noted above, the preset value may be stored in the persistent storage of the controller.

In Step 1825, the controller shuts down a network device associated with the controller.

In Step 1830, if the quantity of present reversible fan modules is greater than the retrieved minimum number of present reversible fan modules, the method ends; otherwise, the method returns to Step 1816.

A reversible fan module according to one or more embodiments may prevent counter airflow due to inactivity of a fan unit within the reversible fan module. Thus, the reversible fan module may provide a redundant cooling system capable of continuing to supply a cooling airflow to electronic components in the event of a failure of a fan module. Moreover, the reversible fan module may provide a mechanism to prevent reverse or circulation of airflow in the event of failure of a fan unit. Further, one or more embodiments of the invention, the system also allows for reduced numbers of active cooling units by creating a single airflow path throughout the chassis. Thus, a single active cooling unit such as the reversible fan module may cool all of the active components in the chassis. Further, embodiments of the invention allows for a single fan module to generate to different airflow paths.

While the invention has been described above with respect to a limited number of embodiments, those skilled in the art, having the benefit of this invention, will appreciate that other embodiments can be devised which do not depart from the scope of the invention as disclosed herein. Accordingly, the scope of the invention should be limited only by the attached claims.

What is claimed is:

1. A reversible fan module, comprising:

a first attachment member configured to receive power from a controller when an orientation of the reversible fan module is a first orientation;

a second attachment member configured to receive power from the controller when the orientation of the reversible fan module is a second orientation;

a first electrical connection, disposed between the first attachment member and the second attachment member, configured to transmit power from the second attachment member to the first attachment member when the orientation of the reversible fan module is the second orientation; and a second electrical connection, disposed between the first attachment member and a fan unit, configured to transmit power to the fan unit.

2. The reversible fan module of claim 1, wherein the first attachment member further comprises:

a first orientation code configured to be read by the controller and identify the orientation of the reversible fan module when the first attachment member receives power directly from the controller.

3. The reversible fan module of claim 1, wherein the second attachment member further comprises:

a second orientation code configured to be read by the controller and identify the orientation of the reversible fan module when the second attachment member receives power directly from the controller.

4. The reversible fan module of claim 1, wherein the second attachment member further comprises:

a second orientation code configured to be read by the controller and identify the orientation of the reversible fan module when the first attachment member receives power from the second attachment member.

5. A system, comprising:

a network device comprising:

a controller configured to:

read an orientation code of an attachment member of a reversible fan module attached to the controller;

send the orientation code to the system controller;

provide power to the reversible fan module if the system controller indicates an orientation of the reversible fan module is acceptable;

the reversible fan module comprising:

a first attachment member configured to receive power from a controller when an orientation of the reversible fan module is a first orientation;

a second attachment member configured to receive power from the controller when the orientation of the reversible fan module is a second orientation;

a first electrical connection, disposed between the first attachment member and the second attachment member, configured to transmit power from the second attachment member to the first attachment member when the orientation of the reversible fan module is the second orientation; and a second electrical connection, disposed between the first attachment member and a fan unit, configured to transmit power to the fan unit.

6. The system of claim 5, further comprising:

a system controller configured to:

receive a message from the controller comprising the orientation code;

identify an orientation of a reversible fan module based on the orientation code;

compare the identified orientation of the reversible fan module to an acceptable orientation;

send a message, to the controller, indicating the acceptability of the identified orientation.

7. The system of claim 5, wherein the network device is a network switch.

8. The system of claim 5, further comprising:

a second reversible fan module comprising:

a third attachment member configured to receive power from a second controller when the orientation of the reversible fan module is a first orientation; and a fourth attachment member configured to receive power from the second controller when the orientation of the reversible fan module is a second orientation.

9. A method, comprising:

determining, by a controller, a quantity of present reversible fan modules;

obtaining, by the controller, a minimum quantity of present reversible fan modules;

initiating, by the controller, a timer; and shutting down, by the controller, a network device if the quantity of present reversible fan modules is less than the minimum quantity of present reversible fan modules when the timer reaches a value stored by the controller.

10. The method of claim 9, wherein the network device is a network switch.

11. The method of claim 9, wherein obtaining comprises:

reading the minimum quantity of present reversible fan modules from a storage of the controller.

12. The method of claim 9, wherein obtaining comprises:

sending, by the controller, a message to a system controller requesting the minimum quantity of present reversible fan modules; and receiving, by the controller, a message from the system controller indicating the minimum quantity of present reversible fan modules.

13. The method of claim 9, wherein determining comprises:

attempting, by the controller, to read at least one presence code of an attachment member of a reversible fan module.

14. A method, comprising:

initiating, by a controller, power transmission to a reversible fan module attached to the controller;

reading, by the controller, an orientation code of an attachment member of a reversible fan module;

sending, by the controller, a message to a system controller indicating the orientation code;

receiving, by the controller, a message from the system controller indicating the acceptability of an orientation of the reversible fan module; and terminating, by the controller, power transmission to the reversible fan module if the received acceptability of the orientation of the reversible fan module is unacceptable.

* * * * *